US011097548B2

(12) United States Patent
Sugitani et al.

(10) Patent No.: US 11,097,548 B2
(45) Date of Patent: Aug. 24, 2021

(54) LIQUID TANK

(71) Applicant: RISO KAGAKU CORPORATION, Tokyo (JP)

(72) Inventors: Hiroshi Sugitani, Ibaraki (JP); Toshihiro Bansyo, Ibaraki (JP); Takehiro Yamori, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/746,053

(22) Filed: Jan. 17, 2020

(65) Prior Publication Data

US 2020/0247133 A1 Aug. 6, 2020

(30) Foreign Application Priority Data

Jan. 31, 2019 (JP) ..... JP2019-015576
Jan. 31, 2019 (JP) ..... JP2019-015624
Jan. 31, 2019 (JP) ..... JP2019-015625

(51) Int. Cl.
*B41J 2/175* (2006.01)
*B41J 2/18* (2006.01)
*B41J 2/185* (2006.01)

(52) U.S. Cl.
CPC ..... *B41J 2/17513* (2013.01); *B41J 2/175* (2013.01); *B41J 2/17523* (2013.01); *B41J 2/17553* (2013.01); *B41J 2/18* (2013.01); *B41J 2/185* (2013.01)

(58) Field of Classification Search
CPC .... B41J 2/17513; B41J 2/17553; B41J 2/175; B41J 2/18; B41J 2/185; B41J 2/17523
See application file for complete search history.

(56) References Cited

U.S. PATENT DOCUMENTS 6,249,655 B1 * 6/2001 Baek ..... G03G 15/0121 222/DIG. 1
6,676,237 B2 1/2004 Kobayashi et al.
2011/0277303 A1 * 11/2011 Mallory ..... B41J 2/17593 29/447
2017/0326881 A1 11/2017 Lebron et al.
2018/0111380 A1 * 4/2018 Kimura ..... B41J 29/13

FOREIGN PATENT DOCUMENTS

EP 2 546 059 1/2013
JP 2010-208265 9/2010
JP 2012-153004 8/2012
JP 2013-163331 8/2013

OTHER PUBLICATIONS

Extended European Search Report for EP20154162.0 dated Jul. 6, 2020.

* cited by examiner

*Primary Examiner* — Yaovi M Ameh
(74) *Attorney, Agent, or Firm* — Greenblum & Bernstein, P.L.C.

(57) ABSTRACT

A tank includes: a liquid container configured to store a liquid; an inlet opening through which the liquid flows into the liquid container; an outlet opening through which the liquid flows out from the liquid container; and a channel formation member arranged between the inlet opening and the outlet opening and configured to form channels. Widths of the channels are such that a channel at a position where stagnation of the liquid is more likely to occur has a larger width.

16 Claims, 27 Drawing Sheets

LIQUID TANK

CROSS REFERENCE TO RELATED APPLICATION

This application is based upon and claims the benefit of priority from the prior Japanese Patent Application Nos. 2019-015576 filed on Jan. 31, 2019, 2019-015624 filed on Jan. 31, 2019 and 2019-015625 filed on Jan. 31, 2019, the entire contents of which are incorporated herein by reference.

BACKGROUND

1. Technical Field

The disclosure relates to a tank that stores a liquid.

2. Related Art

Some inkjet printing apparatuses use pigment inks. Leaving a pigment ink unused sometimes results in sedimentation of its pigment particles. The sedimentation of pigment particles easily occurs particularly in an ink containing pigment particles with a high specific density such as metallic particles.

The sedimentation of the pigment particles in ink increases the viscosity of the ink, which may result in ejection failure at an inkjet head. The sedimentation of the pigment particles in ink may also cause variation in the concentration of the ink ejected from an inkjet head. In a technique in Japanese Patent Application Publication No. 2013-163331, ink is agitated in order to prevent such troubles resulting from the pigment particle sedimentation.

One conceivable technique related to this may be agitating ink stored in a tank by causing the ink to flow out from the tank and then flow into the tank.

Also, in Japanese Patent Application Publication No. 2012-153004, the level of a liquid stored in a tank is detected by using a sensor.

In this technique, whether the liquid in the tank has run out is determined based on whether the sensor detects that the level of the liquid in the tank has lowered to a lower limit level during discharge of the ink.

SUMMARY

Meanwhile, in the case of agitating ink in a tank by causing the ink to flow out and in, ink stagnation sometimes occurs in a certain region(s) inside the tank and lowers the efficiency of the agitation.

Also, ink may splash, for example, when ink flowing into the tank drops onto the ink surface. When ink splashes, air bubbles may be mixed into the ink, for example, which may cause ink ejection failure at an inkjet head.

In the case of detecting the level of a liquid stored in a tank by using a sensor, the detection error of the sensor may lead to a situation where the sensor detects that the liquid level has lowered to a lower limit level and therefore the liquid in the tank is determined to have run out while the actual volume of the liquid remaining in the tank is larger than when the liquid level is at the lower limit level. Thus, a larger volume of liquid may remain inside the tank and be wasted.

The disclosure is directed to a tank achieving improved liquid agitation efficiency.

A tank in accordance with some embodiments includes: a liquid container configured to store a liquid; an inlet opening through which the liquid flows into the liquid container; an outlet opening through which the liquid flows out from the liquid container; and a channel formation member arranged between the inlet opening and the outlet opening and configured to form channels. Widths of the channels are such that a channel at a position where stagnation of the liquid is more likely to occur has a larger width.

With the above configuration, the liquid agitation efficiency is improved.

The channel formation member may include a first channel formation member arranged at a side of the outlet opening and configured to form first channels. Widths of the first channels may be such that a first channel at a longer distance from the outlet opening has a larger width.

With the above configuration, the liquid agitation efficiency is improved.

The channel formation member may include a second channel formation member arranged at a side of the inlet opening and configured to form second channels. Each of the second channels may have a width corresponding to a direction and intensity of a flow of the liquid flowing into the liquid container from the inlet opening and a distance from the inlet opening to the second channel.

With the above configuration, the liquid agitation efficiency is improved.

The liquid container may include a recess which is formed in a bottom surface of the liquid container and at which the inlet opening is open.

With the above configuration, the splashing of the liquid flowing in is reduced.

The tank above may further include: a groove formed in a bottom surface of the liquid container; a discharge opening which is open at the groove and through which the liquid is discharged from the liquid container; and a detector configured to detect whether a level of the liquid in the groove is lower than a lower limit level. The detector may be installed with an upper limit position of a detection range of the detector for the level of the liquid being at a position lower than an upper end position of the groove.

With the above configuration, the volume of the liquid to be wasted is reduced.

DETAILED DESCRIPTION

Figure 1:
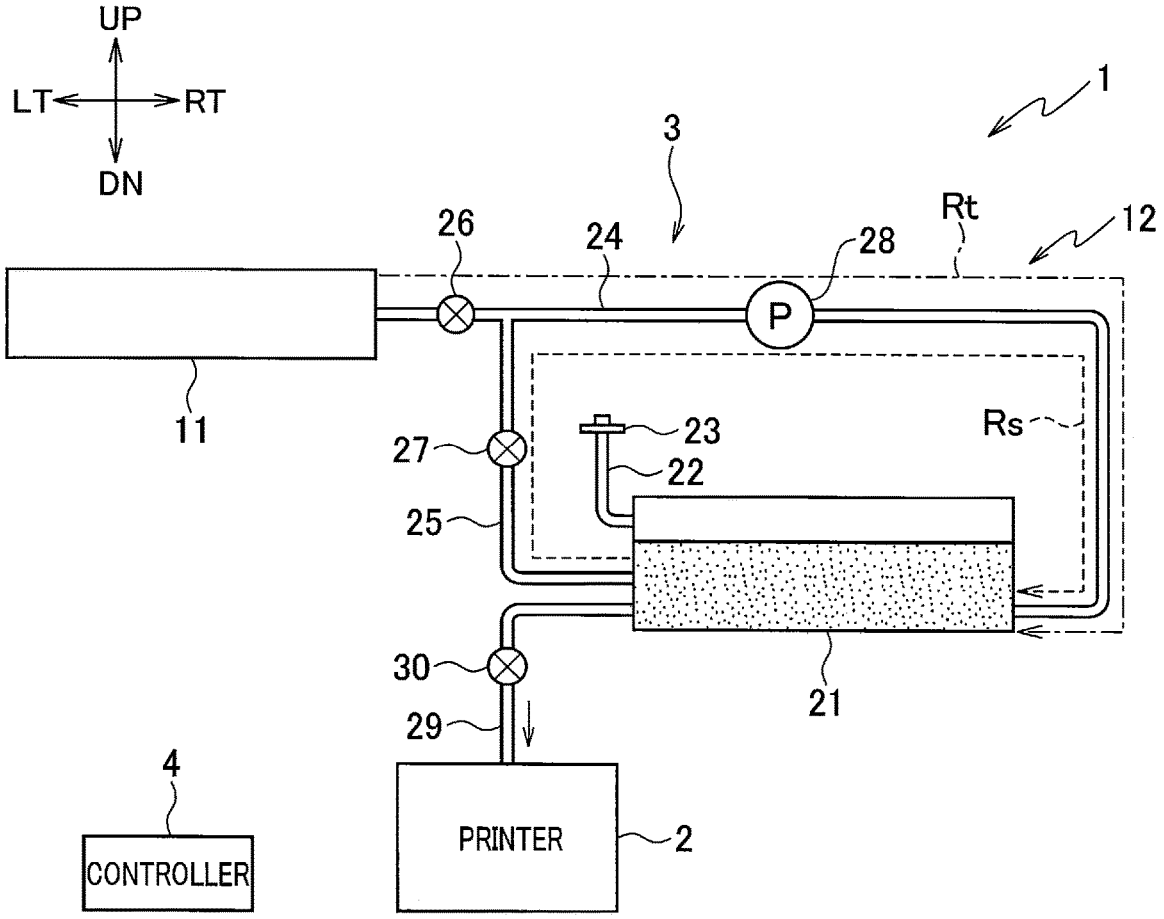
FIG. 1 is a schematic configuration diagram of a printing apparatus provided with a tank according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
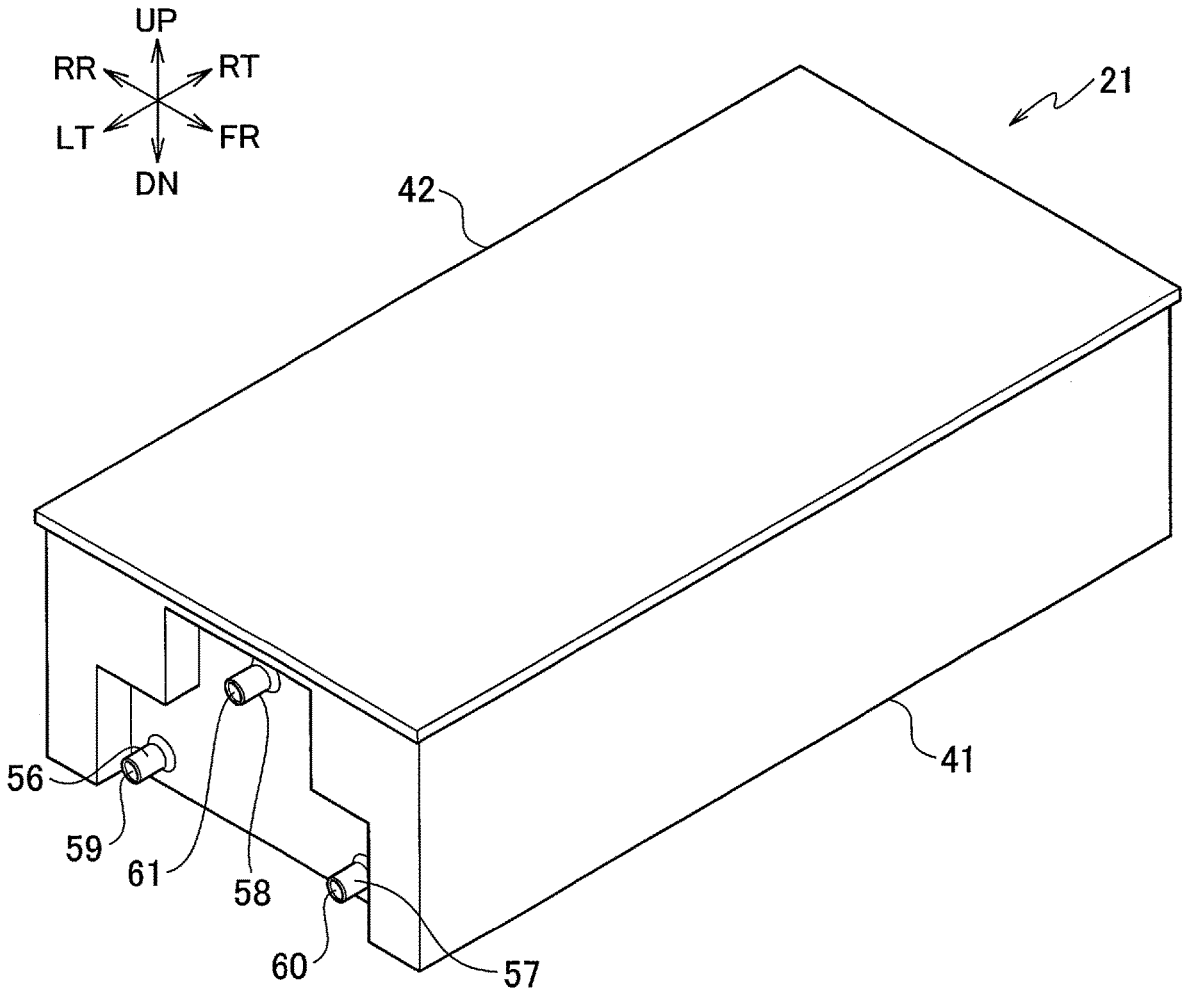
FIG. 2 is a perspective view of the tank according to the first embodiment.
Figure 3:
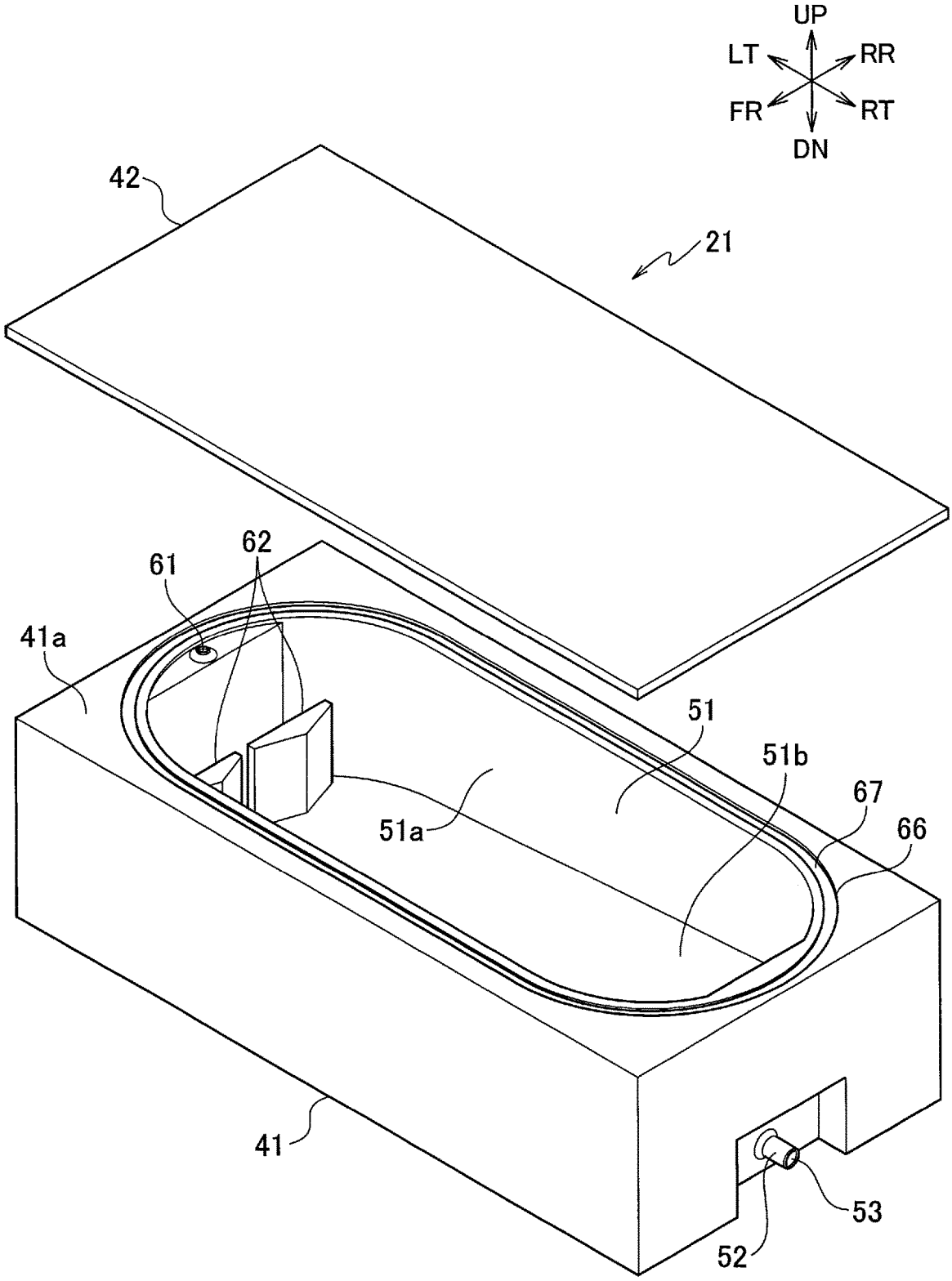
FIG. 3 is an exploded perspective view of the tank according to the first embodiment.
Figure 4:
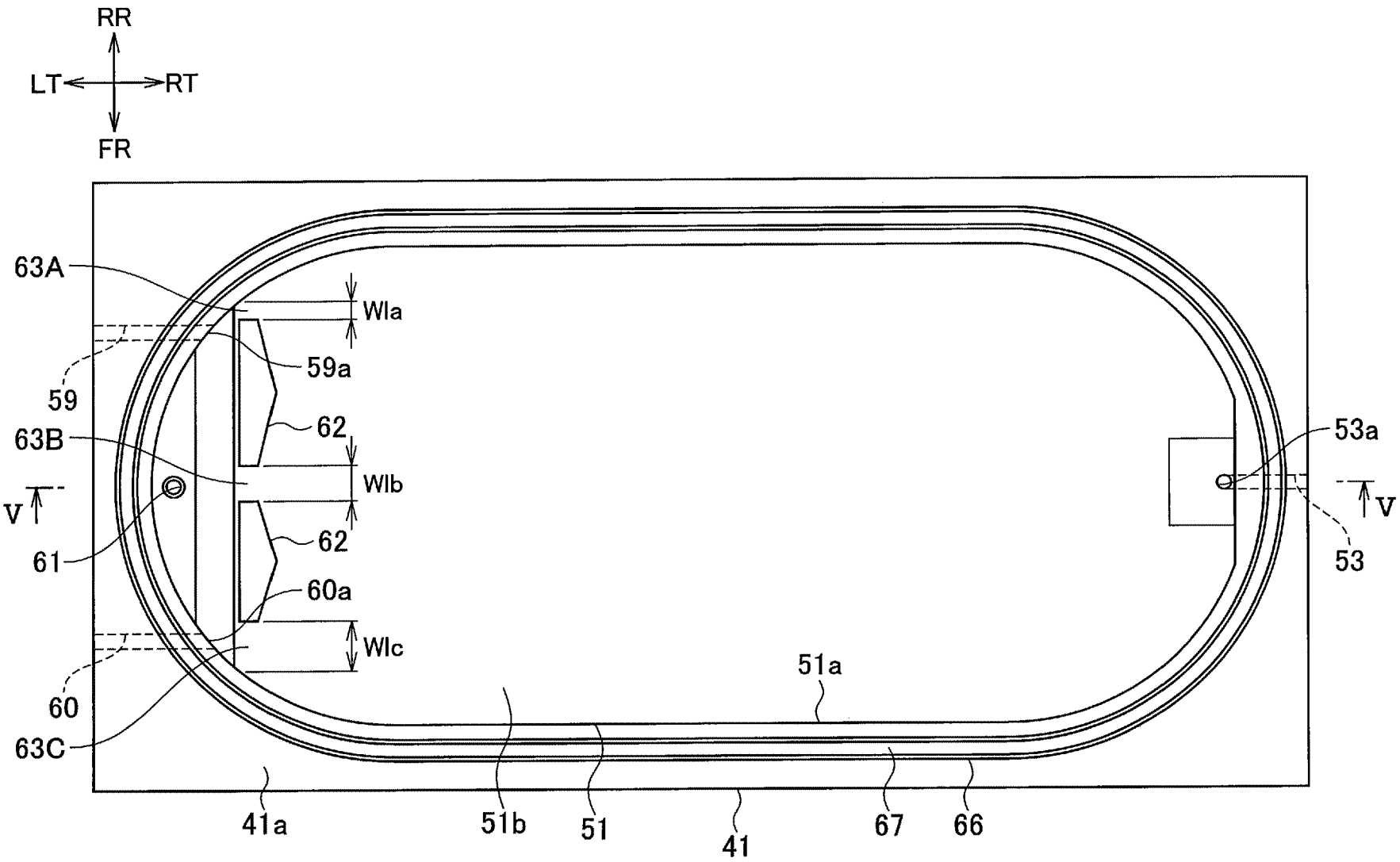
FIG. 4 is a plan view of a tank body in the first embodiment.
Figure 5:
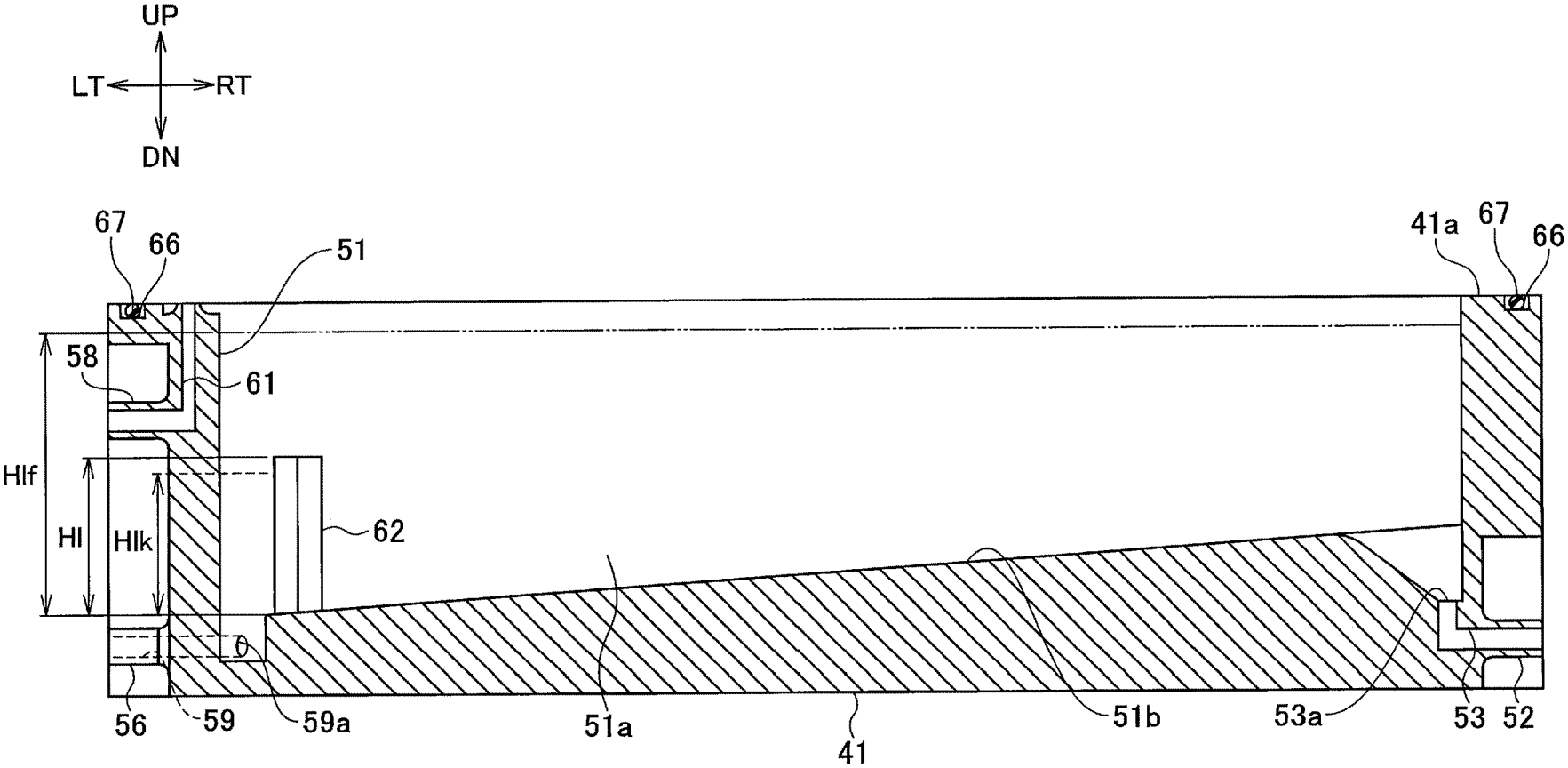
FIG. 5 is a cross-sectional view along line V-V in FIG. 4.

FIG. 1 is a schematic configuration diagram of a printing apparatus 1 provided with a tank 21 according to a first embodiment of the disclosure. FIG. 2 is a perspective view of the tank 21. FIG. 3 is an exploded perspective view of the tank 21. FIG. 4 is a plan view of a tank body 41 of the tank 21. FIG. 5 is a cross-sectional view along line V-V in FIG. 4. Note that in the following description, the direction perpendicular to the sheet surface of FIG. 1 is defined as a front-rear direction, and the front side of the sheet surface is defined as the front side. Also, the up-down and left-right directions of the sheet surface of FIG. 1 are defined as up-down and left-right directions, respectively. Here, the up-down direction illustrated in FIG. 1 is the vertical direction. In FIGS. 1 to 12, the rightward direction, leftward direction, upward direction, downward direction, frontward direction, and rearward direction are denoted as RT, LT, UP, DN, FR, and RR, respectively.

As illustrated in FIG. 1, the printing apparatus 1 includes a printer 2, an ink supply unit 3, and a controller 4.

The printer 2 has an inkjet head (not illustrated) and is configured to print an image on a sheet by ejecting ink onto the sheet from the inkjet head.

The ink supply unit 3 is configured to agitate ink and supply the ink to the printer 2. The ink supply unit 3 includes an ink cartridge 11 and an agitator 12.

Here, the ink used for printing in the printing apparatus 1 is a pigment ink, and its pigment particles may sediment if the ink is left unused. For example, the ink used for printing in the printing apparatus 1 is a magnetic ink character reader (MICR) ink containing metallic particles being magnetic bodies. The sedimentation of the pigment particles in the ink causes troubles such as ejection failure at the inkjet head and variation in the concentration of the ejected ink. Since the pigment particles in the ink may have sedimented inside the ink cartridge 11, the printing apparatus 1 agitates the ink in the agitator 12. In this way, if the pigment particles have sedimented, the sedimentation is solved.

The ink cartridge 11 stores the pigment ink being the ink to be used for printing by the printer 2. The ink cartridge 11 is configured to be attachable to and detachable from the printing apparatus 1.

The agitator 12 is configured to obtain ink from the ink cartridge 11 and agitate the obtained ink. The agitator 12 is configured to supply the agitated ink to the printer 2. The agitator 12 includes the tank 21, an atmosphere opening pipe 22, an air filter 23, an ink transfer pipe 24, an ink outlet pipe 25, an ink transfer valve 26, an agitation valve 27, a pump 28, an ink supply pipe 29, and an ink supply valve 30.

The tank 21 is configured to store the ink obtained from the ink cartridge 11 to agitate it. Details of the tank 21 will be described later.

The atmosphere opening pipe 22 forms an air channel for opening the tank 21 to the atmosphere. The atmosphere opening pipe 22 is connected at one end to the tank 21 and communicates at the other end with the atmosphere through the air filter 23. The air filter 23 is configured to prevent dust and the like in the air from entering the atmosphere opening pipe 22.

The ink transfer pipe 24 is configured to connect the ink cartridge 11 and the tank 21. The ink transfer pipe 24 forms a transfer route Rt being a route through which to transfer ink from the ink cartridge 11 to the tank 21.

The ink outlet pipe 25 is configured to the tank 21 and the ink transfer pipe 24.

The ink outlet pipe 25 and the portion of the ink transfer pipe 24 on the tank 21 side from the point to which the ink outlet pipe 25 is connected form an agitation route Rs. The agitation route Rs is a route to cause ink flow out from the tank 21 and flow back into the tank 21.

The ink transfer valve 26 is configured to open and close the ink channel in the ink transfer pipe 24. The ink transfer valve 26 is arranged at the portion of the ink transfer pipe 24 on the ink cartridge 11 side from the point to which the ink outlet pipe 25 is connected.

The agitation valve 27 is configured to open and close the ink channel in the ink outlet pipe 25.

The ink transfer valve 26 and the agitation valve 27 switch the route to be opened between the transfer route Rt and the agitation route Rs. Specifically, by opening the ink transfer valve 26 and closing the agitation valve 27, the printing apparatus 1 is brought into a state where the transfer route Rt is opened and the agitation route Rs is closed. By closing the ink transfer valve 26 and opening the agitation valve 27, the printing apparatus 1 is brought into a state where the agitation route Rs is opened and the transfer route Rt is closed.

The pump 28 is configured to move ink such that ink flows out from the tank 21 and flows back into the tank 21 through the agitation route Rs to thereby agitate the ink in the tank 21. The pump 28 is also used to transfer ink from the ink cartridge 11 to the tank 21. The pump 28 is arranged at the overlapping portion of the transfer route Rt and the agitation route Rs. Specifically, the pump 28 is arranged at the portion of the ink transfer pipe 24 on the tank 21 side from the point to which the ink outlet pipe 25 is connected.

The ink supply pipe 29 is configured to connect the tank 21 and the printer 2.

The ink supply valve 30 is configured to open and close the ink channel in the ink supply pipe 29. By opening the ink supply valve 30, ink is supplied from the tank 21 to the printer 2.

The controller 4 is configured to control the operations of components in the printing apparatus 1. The controller 4 includes a CPU, an RAM, an ROM, a hard disk drive, and so on.

Next, details of the tank 21 will be described.

As illustrated in FIGS. 2 and 3, the tank 21 includes the tank body 41 and a lid 42.

The tank body 41 is configured to store ink transferred from the ink cartridge 11. The tank body 41 is formed in a substantially cuboidal shape.

The tank body 41 has an ink container 51 (liquid container). The ink container 51 is a portion configured to store ink. The ink container 51 is formed by recessing an upper surface 41*a* of the tank body 41. A peripheral wall 51*a* of the ink container 51 is formed in a substantially oval shape elongated in the left-right direction in a plan view. Specifically, the peripheral wall 51*a* has curved portions at a left end portion and a right end portion of the ink container 51. This makes it easier for ink to flow from a later-described inlet opening 53*a* side (right side) to a later-described outlet opening 59*a* side (left side) and thus improves the ink agitation efficiency.

An ink inlet port 52 is provided on a right side portion of the tank body 41. The ink inlet port 52 is configured to connect the ink transfer pipe 24 to the tank body 41. An ink inlet hole 53 is formed in the ink inlet port 52.

The ink inlet hole 53 is open at one end in the ink inlet port 52 and is open at the other end to a bottom surface 51*b* of the ink container 51 so as to face upward. Thus, the ink inlet hole 53 communicates with the ink container 51, so that ink flows in from the ink transfer pipe 24 to the ink container 51 through the ink inlet hole 53. The opening of the ink inlet hole 53 at the ink container 51 is the inlet opening 53*a*, through which ink is caused to flow into the ink container 51. The inlet opening 53*a* is arranged at the right end portion of the ink container 51 at the center of the ink container 51 in the front-rear direction.

An ink outlet port 56, an ink supply port 57, and an atmosphere opening port 58 are provided on a left side portion of the tank body 41.

The ink outlet port 56 is configured to connect the ink outlet pipe 25 to the tank body 41. An ink outlet hole 59 is formed in the ink outlet port 56.

The ink outlet hole 59 is open at one end in the ink outlet port 56 and is open at the other end to a lower portion of the peripheral wall 51*a* of the ink container 51. Thus, the ink outlet hole 59 communicates with the ink container 51, so that ink flows out from the ink container 51 to the ink outlet pipe 25 through the ink outlet hole 59. The opening of the ink outlet hole 59 at the ink container 51 is the outlet opening 59*a*, through which ink is caused to flow out from the ink container 51 to the ink outlet pipe 25. The outlet opening 59*a* is arranged at the left end portion of the ink container 51 on the rear side relative to the center of the ink container 51 in the front-rear direction.

The ink supply port 57 is configured to connect the ink supply pipe 29 to the tank body 41. An ink supply hole 60 is formed in the ink supply port 57.

The ink supply hole 60 is open at one end in the ink supply port 57 and is open at the other end to a lower portion of the peripheral wall 51*a* of the ink container 51. Thus, the ink supply hole 60 communicates with the ink container 51, so that ink flows out from the ink container 51 to the ink supply pipe 29 through the ink supply hole 60. The opening of the ink supply hole 60 at the ink container 51 is a supply opening 60*a* through which ink is supplied from the ink container 51 to the printer 2 via the ink supply pipe 29. The supply opening 60*a* is arranged at the left end portion of the ink container 51 on the front side relative to the center of the ink container 51 in the front-rear direction.

The atmosphere opening port 58 is configured to connect the atmosphere opening pipe 22 to the tank body 41. An atmosphere communication hole 61 is formed in the atmosphere opening port 58. The atmosphere communication hole 61 allows the internal space of the tank body 41 covered by the lid 42 (ink container 51) to communicate with the atmosphere to thereby open the tank 21 to the atmosphere.

The bottom surface 51*b* of the ink container 51 is inclined downward toward the left side. Specifically, the bottom surface 51*b* is inclined to be lower from the inlet opening 53*a* side to the outlet opening 59*a* side. This makes it easier for ink to flow from the inlet opening 53*a* side to the outlet opening 59*a* side and thus improves the ink agitation efficiency. The bottom surface 51*b* is recessed around the inlet opening 53*a*, and the inlet opening 53*a* is open at the bottom of the recess.

Flow regulation walls 62 (channel formation member) are provided upright on the bottom surface 51*b* of the ink container 51. The flow regulation walls 62 are provided upright at predetermined positions which are closer to the outlet opening 59*a* than to the inlet opening 53*a* in the left-right direction and near the right side (inlet opening 53*a* side) of the outlet opening 59*a*. In the first embodiment, two flow regulation walls 62 are arranged side by side in the front-rear direction.

The flow regulation walls 62 are members configured to form ink channels 63A to 63C near the right side of the outlet opening 59*a*. The channel 63A is formed by the gap between the rear flow regulation wall 62 and the peripheral wall 51*a* on the rear side of this flow regulation wall 62. The channel 63B is formed by the gap between the two flow regulation walls 62. The channel 63C is formed by the gap between the front flow regulation wall 62 and the peripheral wall 51*a* on the front side of this flow regulation wall 62. Note that the alphabetical suffixes in reference numerals, such as those in "channels 63A to 63C", may be omitted to collectively indicate the components.

The longer the distance from the outlet opening 59*a* to the channel 63, the larger the width of the channel 63. Specifically, as illustrated in FIG. 4, the widths of the channels 63A, 63B, and 63C, denoted as Wla, Wlb, and Wlc respectively, are set such that Wla<Wlb<Wlc. Thus, the farther the channel 63 is from the outlet opening 59*a*, the lower the channel resistance is.

In a region near the right side of the outlet opening 59*a*, ink stagnation is more likely to occur at a region farther from the outlet opening 59*a* during a later-described agitation operation. Thus, by setting the widths Wla, Wlb, and Wlc as Wla<Wlb<Wlc so that a channel 63 farther from the outlet opening 59*a* can have a lower channel resistance, the flow rate of ink near the right side of the outlet opening 59*a* is made uniform in the front-rear direction. This suppresses ink stagnation.

As illustrated in FIG. 5, a height Hl of the flow regulation walls 62 (the height of their upper ends) is more than or equal to a prescribed height Hlk and less than a maximum depth Hlf of ink at the positions where the flow regulation walls 62 are installed.

During the later-described agitation operation, the larger the volume of ink in the ink container 51, the more likely it is that ink stagnation in the up-down direction occurs. Specifically, the larger the volume of ink in the ink container 51, the more likely it is that stagnation occurs at an upper portion of the ink. However, with the flow regulation walls 62 installed, ink flows over the flow regulation walls 62. This suppresses ink stagnation in the up-down direction.

Here, Hl<Hlf is set since if the height Hl of the flow regulation walls 62 is more than or equal to the maximum depth Hlf, installing the flow regulation walls 62 prevents ink from flowing over the flow regulation walls 62 and may cause ink stagnation in the up-down direction. The maximum depth Hlf corresponds to the height from the bottom surface 51*b* at the positions where the flow regulation walls 62 are installed to the ink surface in the ink container 51 in a state where ink is stored in the ink container 51 to such an extent that the ink level reaches the upper limit level.

The prescribed height Hlk is set according to the maximum depth Hlf so that ink stagnation in the up-down direction can be suppressed even in the case where the ink stored in the ink container 51 has the maximum depth Hlf. The height Hl of the flow regulation walls 62 is determined within a range satisfying Hlk≤Hl<Hlf based on tests or the like, for example.

A seal groove 66 is formed in the tank body 41. The seal groove 66 is formed to surround the ink container 51. The seal groove 66 is a groove in which to install a seal member 67. The seal member 67 is a member configured to prevent leakage of the ink in the ink container 51 from the tank 21.

The lid 42 is configured to cover the top of the tank body 41. The lid 42 is placed on the upper surface 41*a* of the tank body 41.

Next, a description will be given of the operation of transferring ink from the ink cartridge 11 to the tank 21 and the operation of agitating ink in the agitator 12 in the printing apparatus 1.

When a sensor (not illustrated) detects that the liquid level of the ink in the tank 21 has reached a predetermined lower limit level or lower, ink is transferred from the ink cartridge 11 to the tank 21.

In doing so, the controller 4 opens the ink transfer valve 26 and closes the agitation valve 27. As a result, the printing apparatus 1 is brought into the state where the transfer route Rt is opened and the agitation route Rs is closed. Meanwhile, the printing apparatus 1 is equipped with a new ink cartridge 11.

Then, the controller 4 starts driving the pump 28. As a result, ink is transferred from the ink cartridge 11 to the tank 21 through the transfer route Rt.

After the ink in the ink cartridge 11 is all transferred to the tank 21, the controller 4 closes the ink transfer valve 26 and opens the agitation valve 27. As a result, the printing apparatus 1 is switched to the state where the agitation route Rs is opened and the transfer route Rt is closed. Ink is then circulated along the agitation route Rs, so that the ink in the tank 21 is agitated.

After the elapse of a prescribed time since the start of the agitation of the ink in the tank 21, the controller 4 stops the pump 28 and closes the agitation valve 27. As a result, the ink agitation operation by the agitator 12 is finished.

When the printer 2 performs printing, ink transferred to the tank 21 and agitated in the above manner is supplied to the printer 2 as necessary.

The agitation operation in the agitator 12 is performed not only immediately after the above-described ink transfer from the ink cartridge 11 to the tank 21 but also at regular intervals of a predetermined time, for example, in order to prevent sedimentation of the pigment particles in the ink in the tank 21.

During the above-described agitation operation, ink having flowed into the ink container 51 from the inlet opening 53*a* passes through the channels 63A to 63C, so that its flow rate is made uniform in the front-rear direction, and the ink then flows out from the outlet opening 59*a*. This suppresses generation of ink stagnation spots in a plan view.

Since the ink flows from the right side to the left side of the flow regulation walls 62 by flowing over the flow regulation walls 62, ink stagnation in the up-down direction is suppressed. Note that when the surface of the ink in the ink container 51 is lower than the upper ends of the flow regulation walls 62 during the agitation operation, ink stagnation in the up-down direction hardly occurs since the depth of the ink is sufficiently shallow.

Since ink stagnation is suppressed as described above, the ink in the tank 21 is agitated efficiently.

As described above, in the printing apparatus 1, the flow regulation walls 62, which form the channels 63A to 63C, are provided on the right side (inlet opening 53*a* side) of the outlet opening 59*a* of the tank 21. The longer the distance from the outlet opening 59*a* to the channel 63, the larger the width of the channel 63. Thus, the flow rate of ink near the right side of the outlet opening 59*a* flowing toward the outlet opening 59*a* is made uniform in the front-rear direction, so that ink stagnation is suppressed. As a result, the ink agitation efficiency is improved.

In the printing apparatus 1, the height H1 of the flow regulation walls 62 is more than or equal to the prescribed height Hlk and less than the maximum depth Hlf. This suppresses ink stagnation in the up-down direction and thus further improves the ink agitation efficiency.

Next, a second embodiment implemented by changing the tank body 41 of the tank 21 in the first embodiment will be described.

Figure 6:
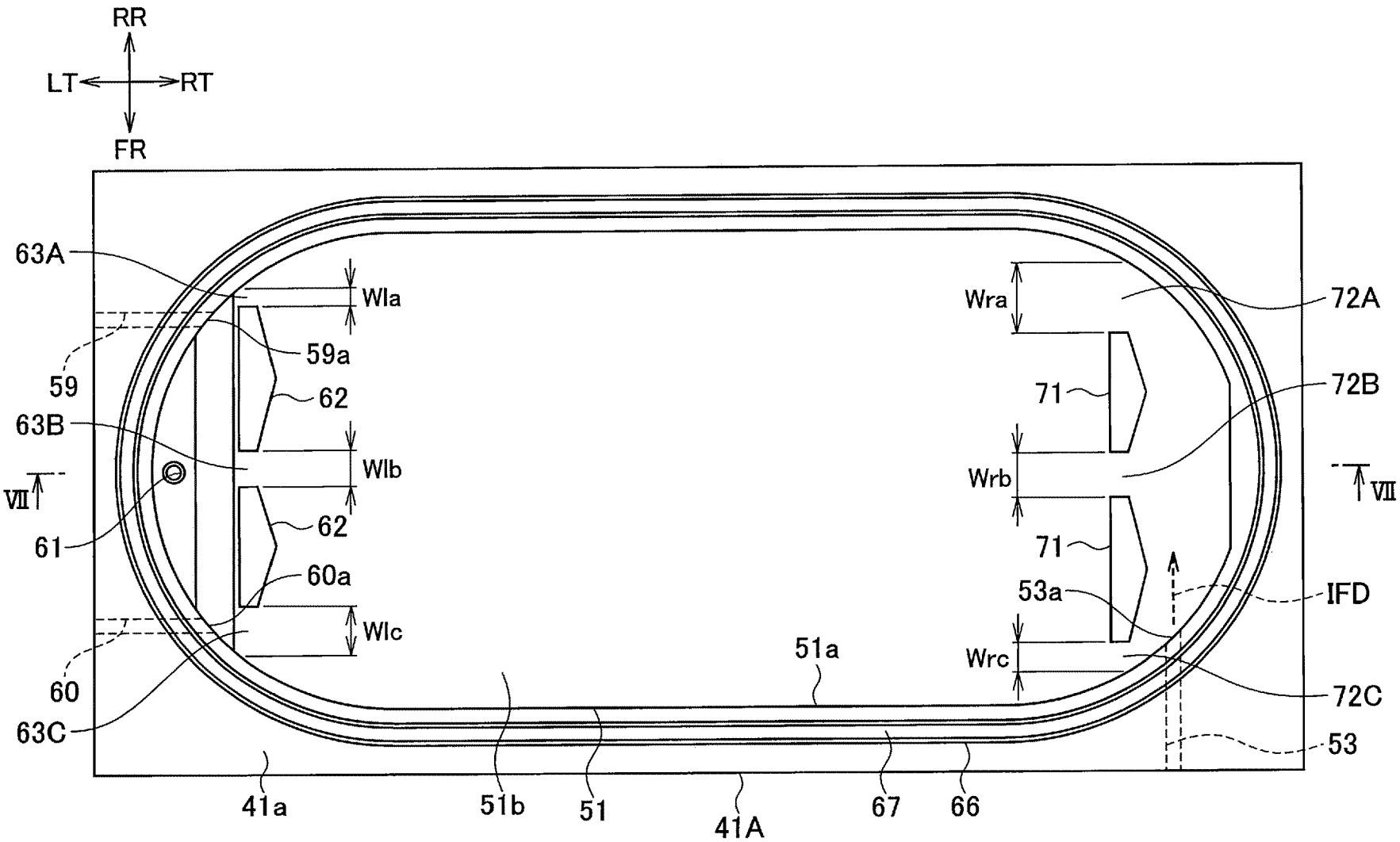
FIG. 6 is a plan view of a tank body according to a second embodiment.
Figure 7:
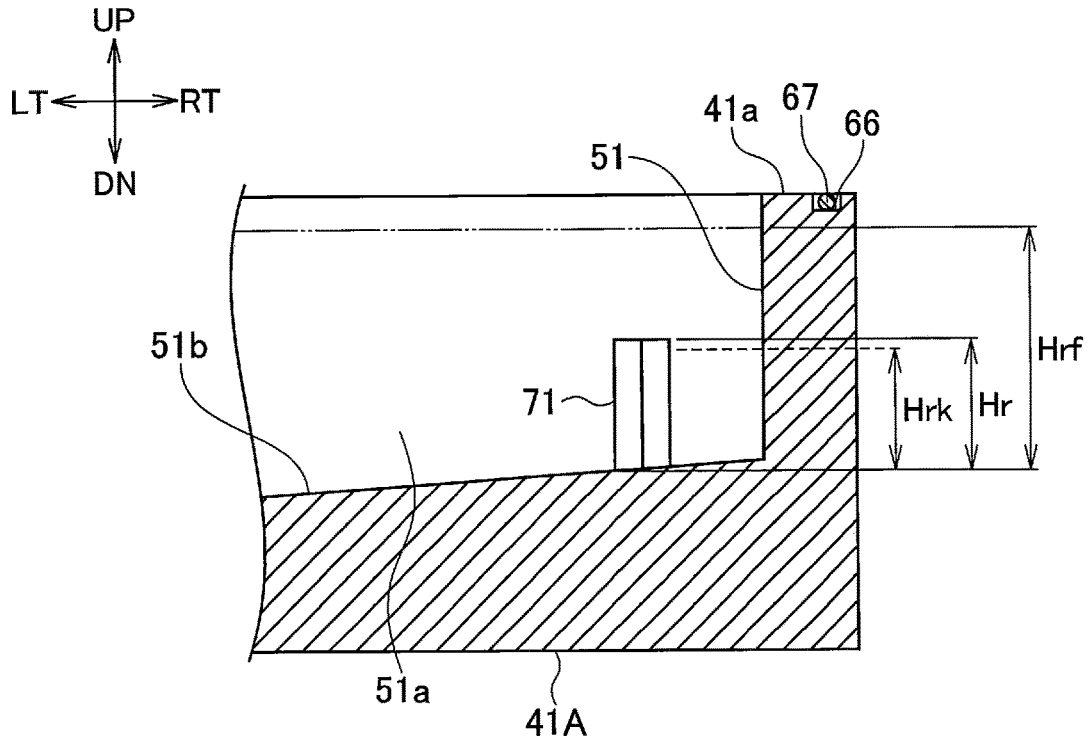
FIG. 7 is a partial cross-sectional view along line VII-VII in FIG. 6.

FIG. 6 is a plan view of a tank body 41A in the second embodiment. FIG. 7 is a partial cross-sectional view along line VII-VII in FIG. 6.

As illustrated in FIGS. 6 and 7, the tank body 41A in the second embodiment represents a configuration obtained by changing the position of the inlet opening 53*a* from that of the tank body 41 in the first embodiment and adding flow regulation walls 71 (channel formation member, inlet-side channel formation member) to the tank body 41 in the first embodiment.

In the tank body 41A, an ink inlet port 52 (not illustrated in FIG. 6) is provided on the front side. An ink inlet hole 53 of the tank body 41A is formed near the right end of an ink container 51 to extend horizontally from the front side of the tank body 41A toward the rear side and is open to a peripheral wall 51*a* of the ink container 51. The inlet opening 53*a*, which is an opening of this ink inlet hole 53, is formed at a lower portion of the peripheral wall 511*a* near the right end of a front portion of the peripheral wall 51*a*. Thus, ink flows into the ink container 51 of the tank body 41A from the inlet opening 53*a* in a flow direction from the front side toward the rear side.

The flow regulation walls 71 are provided upright at predetermined positions which are closer to the inlet opening 53*a* than to an outlet opening 59*a* in the left-right direction and near the left side (outlet opening 59*a* side) of the inlet opening 53*a*. In the second embodiment, two flow regulation walls 71 are arranged side by side in the front-rear direction.

The flow regulation walls 71 are members configured to form ink channels 72A to 72C near the left side of the inlet opening 53*a*. The channel 72A is formed by the gap between the rear flow regulation wall 71 and the peripheral wall 51*a* on the rear side of this flow regulation wall 71. The channel 72B is formed by the gap between the two flow regulation walls 71. The channel 72C is formed by the gap between the front flow regulation wall 71 and the peripheral wall 51*a* on the front side of this flow regulation wall 71.

The width of each channel 72 is determined according to a direction IFD and intensity of the flow of ink flowing into the ink container 51 from the inlet opening 53*a* and the distance from the inlet opening 53*a* to the channel 72.

Here, as mentioned above, the direction IFD of the flow of ink flowing into the ink container 51 of the tank body 41A from the inlet opening 53*a* is a direction from the front side toward the rear side. In this case, where ink stagnation is likely to occur in a region near the inlet opening 53*a* varies depending on the intensity of the flow of ink flowing into the ink container 51 from the inlet opening 53*a*. Specifically, when the flow of ink flowing into the ink container 51 from the inlet opening 53*a* is relatively weak, ink stagnation is more likely to occur at a position farther from the inlet opening 53*a* (closer to the rear side) in a region near the left side of the inlet opening 53*a*. On the other hand, when the flow of ink flowing into the ink container 51 from the inlet opening 53*a* is relatively strong, ink stagnation is more likely to occur at a position closer to the inlet opening 53*a* (closer to the front side) in the region near the left side of the inlet opening 53*a*.

In the example of FIG. 6, the intensity of the flow of ink flowing into the ink container 51 from the inlet opening 53*a* is relatively weak and is such an intensity that ink stagnation is more likely to occur at a position farther from the inlet opening 53*a* (closer to the rear side) in the region near the left side of the inlet opening 53*a*. Thus, the widths of the channels 72A, 72B, and 72C, denoted as Wra, Wrb, and Wrc respectively, are set such that Wra>Wrb>Wrc, so that the farther the channel 72 is from the inlet opening 53*a*, the lower the channel resistance is. Thus, the flow rate of ink near the left side of the inlet opening 53*a* is made uniform in the front-rear direction, so that ink stagnation is suppressed.

As illustrated in FIG. 7, a height Hr of the flow regulation walls 71 (the height of their upper ends) is more than or equal to a prescribed height Hrk and less than a maximum depth Hrf of ink at the positions where the flow regulation walls 71 are installed. The reason for setting the height Hr of the flow regulation walls 71 within this range is similar to the above-mentioned reason for setting the height Hl of the flow regulation walls 62 on the outlet opening 59*a* side such that Hlk≤Hl<Hlf. The height Hr of the flow regulation walls 71 is determined within a range satisfying Hrk≤Hr<Hrf based on tests or the like, for example.

The maximum depth Hlf corresponds to the height from a bottom surface 51*b* at the positions where the flow regulation walls 71 are installed to the ink surface in the ink container 51 in a state where ink is stored in the ink container 51 to such an extent that the ink level reaches the upper limit level. The prescribed height Hrk is set according to the maximum depth Hrf so that ink stagnation in the up-down direction can be suppressed even in the case where the ink stored in the ink container 51 has the maximum depth Hrf.

In the tank body 41A, during the agitation operation, ink having flowed into the ink container 51 from the inlet opening 53*a* passes through the channels 72A to 72C, so that its flow rate is made uniform in the front-rear direction. Then, the flow rate of the ink is made uniform in the front-rear direction also when the ink passes through the channels 63A to 63C, and then the ink flows out from the outlet opening 59*a*. This suppresses generation of ink stagnation spots in a plan view.

Since ink flows over the flow regulation walls 71 and then flows over the flow regulation walls 62, ink stagnation in the up-down direction is suppressed. Note that when the surface of the ink in the ink container 51 is lower than the upper ends of at least the flow regulation walls 62 or 71 during the agitation operation, ink stagnation in the up-down direction hardly occurs since the depth of the ink is sufficiently shallow.

As described above, the tank body 41A is provided with the flow regulation walls 71 on the inlet opening 53*a* side, which form the channels 72A to 72C, in addition to the flow regulation walls 62 on the outlet opening 59*a* side. The width of each channel 72 is determined according to the direction IFD and intensity of the flow of ink flowing into the ink container 51 from the inlet opening 53*a* and the distance from the inlet opening 53*a* to the channel 72. Thus, the flow rate of ink near the left side of the inlet opening 53*a* is also made uniform in the front-rear direction, so that ink stagnation is suppressed. As a result, the ink agitation efficiency is further improved.

The height Hr of the flow regulation walls 71 is more than or equal to the prescribed height Hrk and less than the maximum depth Hrf. This suppresses ink stagnation in the up-down direction near the inlet opening 53*a* and thus further improves the ink agitation efficiency.

Figure 8:
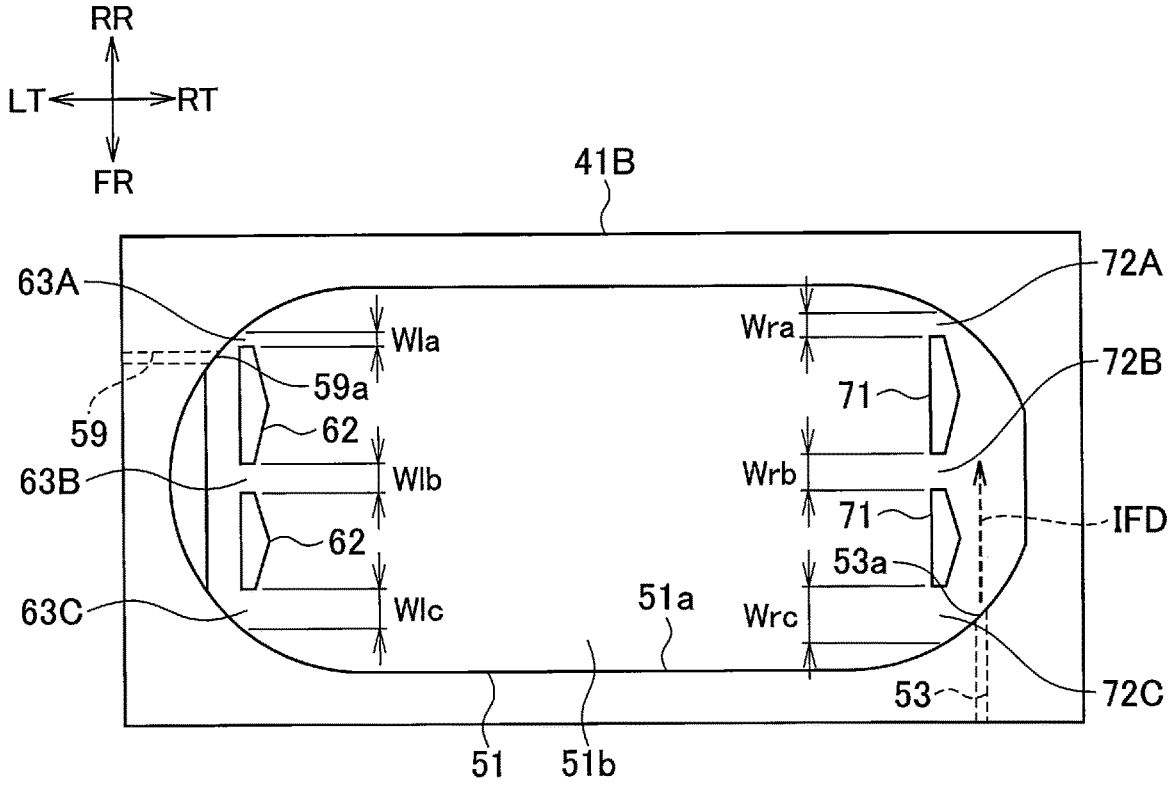
FIG. 8 is a schematic plan view of a tank body according to modification 1 of the second embodiment.

FIG. 8 is a schematic plan view of a tank body 41B according to modification 1 of the second embodiment. Note that illustration of a seal groove 66 and so on is omitted in FIG. 8 to simplify the drawing. The same applies to FIGS. 9 to 12 to be mentioned later.

As illustrated in FIG. 8, the tank body 41B according to modification 1 represents a configuration obtained by changing the magnitude relation between the widths Wra, Wrb, and Wrc of the channels 72A, 72B, and 72C from that in the tank body 41A in the second embodiment illustrated in FIGS. 6 and 7.

Here, in modification 1, the intensity of the flow of ink flowing into the ink container 51 from the inlet opening 53*a* is relatively strong and is such an intensity that ink stagnation is more likely to occur at a position closer to the inlet opening 53*a* (closer to the front side) in the region near the left side of the inlet opening 53*a*.

Thus, in the tank body 41B, the two flow regulation walls 71 are arranged such that the magnitude relation between the widths Wra, Wrb, and Wrc of the channels 72A, 72B, and 72C is Wra<Wrb<Wrc.

Hence, in the tank body 41B, for a configuration in which the flow of ink flowing into the ink container 51 from the inlet opening 53*a* is relatively strong, the flow rate of the ink near the left side of the inlet opening 53*a* is made uniform in the front-rear direction, so that ink stagnation is suppressed.

Figure 9:
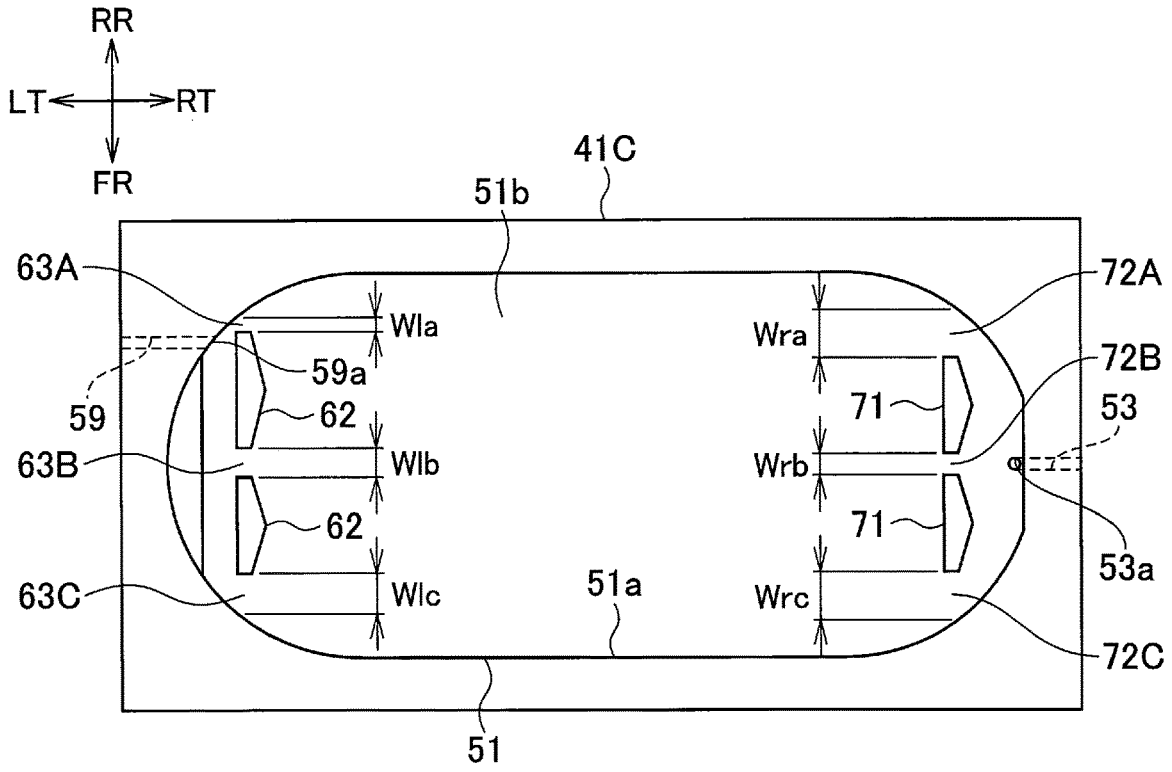
FIG. 9 is a schematic plan view of a tank body according to modification 2 of the second embodiment.

FIG. 9 is a schematic plan view of a tank body 41C according to modification 2 of the second embodiment.

As illustrated in FIG. 9, the tank body 41C according to modification 2 represents a configuration obtained by adding the flow regulation walls 71 to the tank body 41 in the first embodiment.

In the tank body 41C too, like the tank body 41A in the second embodiment, two flow regulation walls 71 are arranged side by side in the front-rear direction at predetermined positions near the left side of the inlet opening 53*a*, and the channels 72A, 72B, and 72C are formed. The channels 72A and 72C are at the same distance from the inlet opening 53*a* while the channel 72B is at a shorter distance from the inlet opening 53*a* than the channels 72A and 72C are. The height Hr of the flow regulation walls 71 is set similar to that in the tank body 41A in the second embodiment.

Here, in the tank body 41C, the inlet opening 53*a* is open to face upward, as in the first embodiment. Thus, the direction of the flow of ink flowing into the ink container 51 from the inlet opening 53*a* is upward.

In this case, ink stagnation is more likely to occur at a position farther from the inlet opening 53*a* in a region near the left side of the inlet opening 53*a*, irrespective of the intensity of the flow of ink flowing into the ink container 51 from the inlet opening 53*a*. Specifically, in the region near the left side of the inlet opening 53*a*, ink stagnation is not likely to occur at a center portion in the front-rear direction whereas ink stagnation is more likely to occur at a position closer to the front side from the center portion and at a position closer to the rear side from the center portion.

For this reason, in the tank body 41C, the magnitude relation between the widths Wra, Wrb, and Wrc of the channels 72A, 72B, and 72C is set to be Wra=Wrc>Wrb, so that the farther the channel 72 is from the inlet opening 53*a*, the lower the channel resistance is.

Thus, in the tank body 41C too, the flow rate of ink near the left side of the inlet opening 53*a* is made uniform in the front-rear direction, so that ink stagnation is suppressed.

Figure 10:
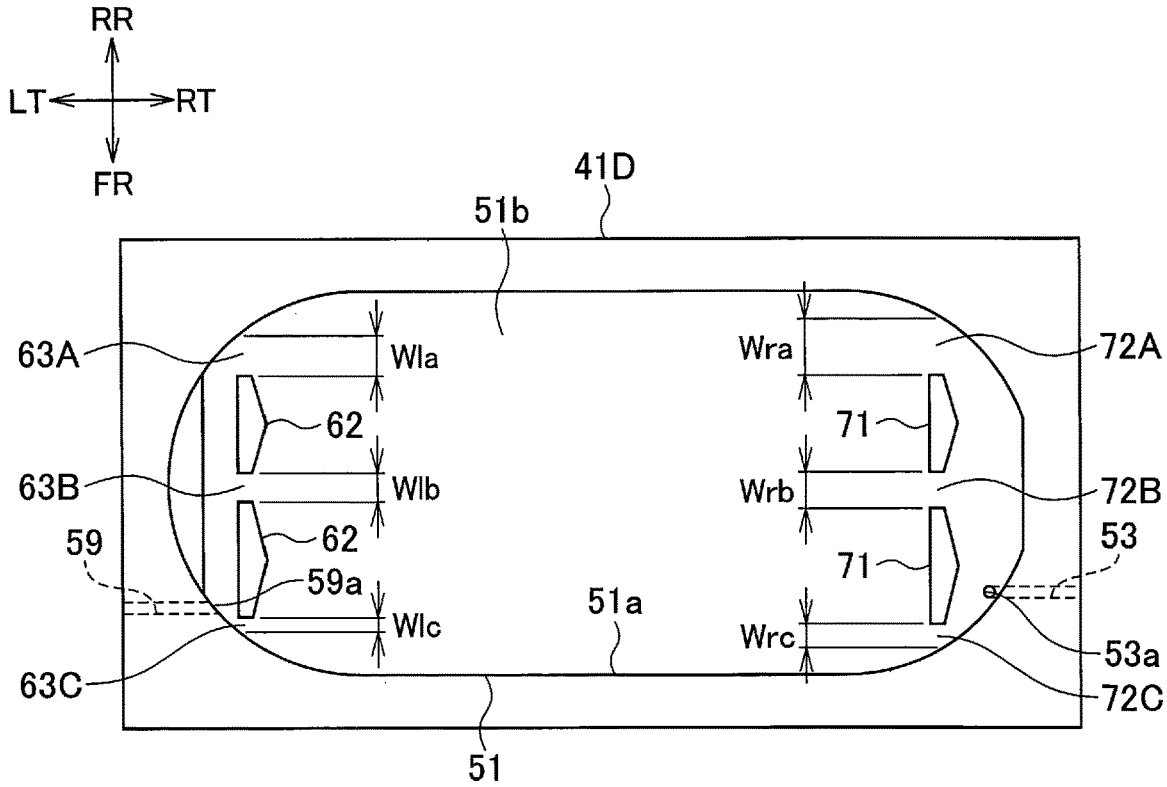
FIG. 10 is a schematic plan view of a tank body according to modification 3 of the second embodiment.

FIG. 10 is a schematic plan view of a tank body 41D according to modification 3 of the second embodiment.

As illustrated in FIG. 10, the tank body 41D according to modification 3 represents a configuration obtained by changing the positions of the inlet opening 53*a* and the outlet opening 59*a*, the magnitude relation between the widths Wla, Wlb, and Wlc of the channels 63A, 63B, and 63C, and the magnitude relation between the widths Wra, Wrb, and Wrc of the channels 72A, 72B, and 72C from those in the tank body 41C in modification 2.

In the tank body 41D, the ink inlet hole 53 is arranged on the front side relative to the center in the front-rear direction. Moreover, the inlet opening 53*a* is arranged at a right end portion of the ink container 51 on the front side relative to the center of the ink container 51 in the front-rear direction. The inlet opening 53*a* is open at the bottom surface 51*b* of the ink container 51 so as to face upward. Thus, the direction of the flow of ink flowing into the ink container 51 from the inlet opening 53*a* is upward.

In the tank body 41D too, like the tank body 41C in modification 2, ink stagnation is more likely to occur at a position farther from the inlet opening 53*a* in a region near the left side of the inlet opening 53*a*, irrespective of the intensity of the flow of ink flowing into the ink container 51 from the inlet opening 53*a*.

For this reason, in the tank body 41D, the magnitude relation between the widths Wra, Wrb, and Wrc of the channels 72A, 72B, and 72C is set to be Wra=Wrc>Wrb, so that the farther the channel 72 is from the inlet opening 53*a*, the lower the channel resistance is.

Thus, in the tank body 41D too, the flow rate of ink near the left side of the inlet opening 53*a* is made uniform in the front-rear direction, so that ink stagnation is suppressed.

In the tank body 41D, the ink outlet hole 59 is arranged on the front side relative to the center in the front-rear direction. Moreover, the outlet opening 59*a* is arranged at a left end portion of the ink container 51 on the front side relative to the center of the ink container 51 in the front-rear direction.

Here, the magnitude relation between the widths Wla, Wlb, and Wlc of the channels 63A, 63B, and 63C is set to be Wra>Wrb>Wrc, so that the farther the channel 63 is from the outlet opening 59*a*, the lower the channel resistance is.

Thus, in the tank body 41D too, the flow rate of ink near the right side of the outlet opening 59*a* is made uniform in the front-rear direction, so that ink stagnation is suppressed.

Figure 11:
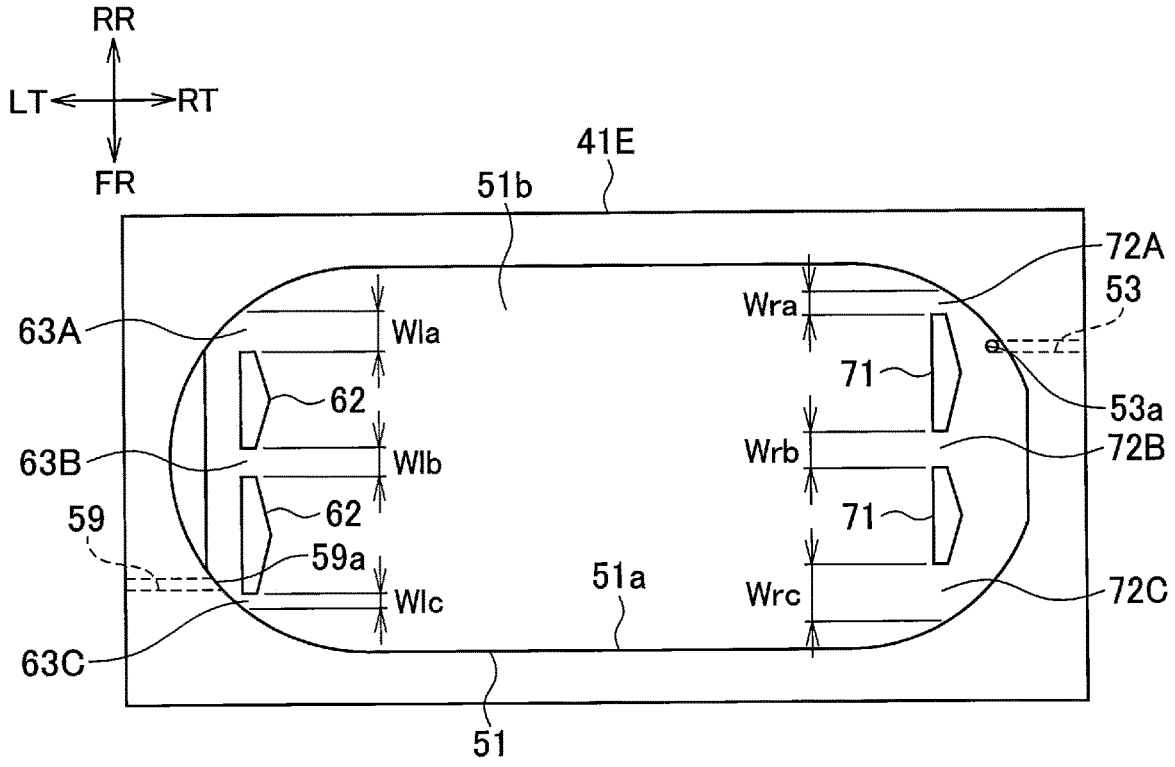
FIG. 11 is a schematic plan view of a tank body according to modification 4 of the second embodiment.

FIG. 11 is a schematic plan view of a tank body 41E according to modification 4 of the second embodiment.

As illustrated in FIG. 11, the tank body 41E according to modification 4 represents a configuration obtained by changing the position of the inlet opening 53*a* and the magnitude relation between the widths Wra, Wrb, and Wrc of the channels 72A, 72B, and 72C from those in the tank body 41D in modification 3.

In the tank body 41E, the ink inlet hole 53 is arranged on the rear side relative to the center in the front-rear direction. Moreover, the inlet opening 53*a* is arranged at the right end portion of the ink container 51 on the rear side relative to the center of the ink container 51 in the front-rear direction. The inlet opening 53*a* is open at the bottom surface 51*b* of the ink container 51 so as to face upward. Thus, the direction of the flow of ink flowing into the ink container 51 from the inlet opening 53*a* is upward.

In the tank body 41E too, like the tank body 41C in modification 2, ink stagnation is more likely to occur at a position farther from the inlet opening 53*a* in a region near the left side of the inlet opening 53*a*, irrespective of the intensity of the flow of ink flowing into the ink container 51 from the inlet opening 53*a*.

For this reason, in the tank body 41E, the magnitude relation between the widths Wra, Wrb, and Wrc of the channels 72A, 72B, and 72C is set to be Wra<Wrb<Wrc, so that the farther the channel 72 is from the inlet opening 53*a*, the lower the channel resistance is.

Thus, in the tank body 41E too, the flow rate of ink near the left side of the inlet opening 53*a* is made uniform in the front-rear direction, so that ink stagnation is suppressed.

Figure 12:
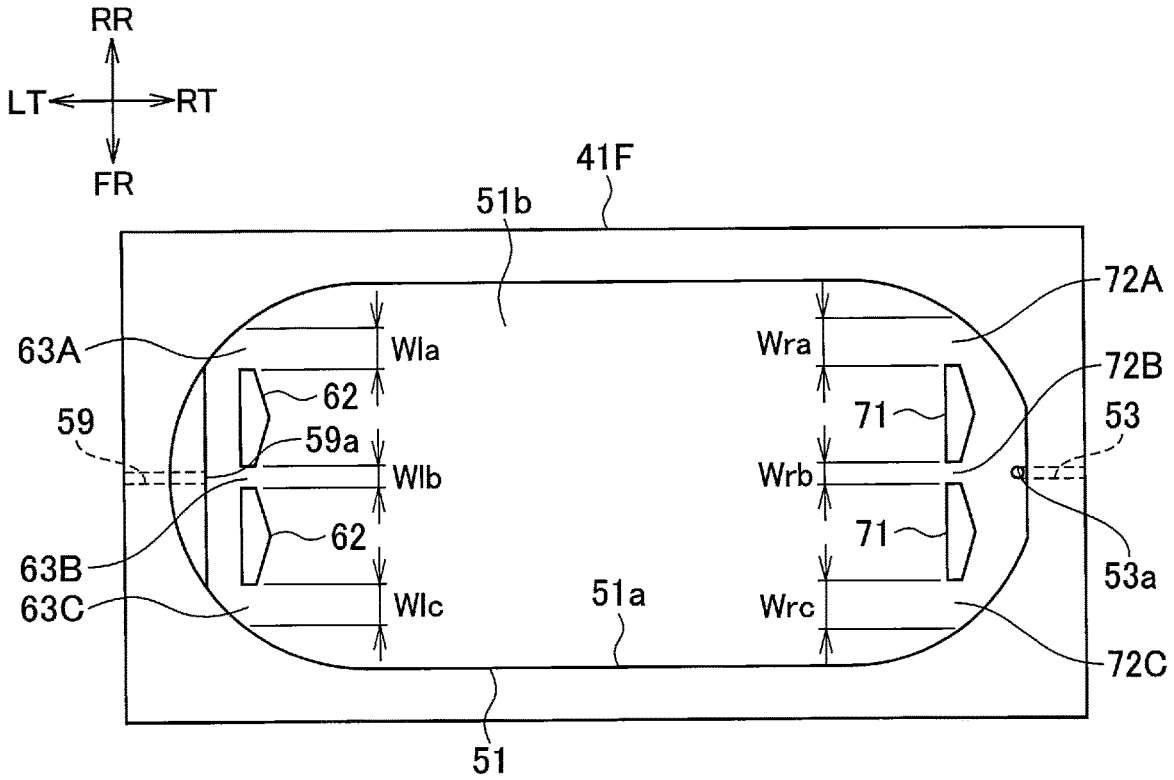
FIG. 12 is a schematic plan view of a tank body according to modification 5 of the second embodiment.

FIG. 12 is a schematic plan view of a tank body 41F according to modification 5 of the second embodiment.

As illustrated in FIG. 12, the tank body 41F according to modification 5 represents a configuration obtained by changing the position of the outlet opening 59*a* and the magnitude relation between the widths Wla, Wlb, and Wlc of the channels 63A, 63B, and 63C from those in the tank body 41C in modification 2.

In the tank body 41F, the ink inlet hole 59 is arranged at the center in the front-rear direction. Moreover, the outlet opening 59*a* is open at the peripheral wall 51*a* at the center of the ink container 51 in the front-rear direction. The inlet opening 53*a* is open at the bottom surface 51*b* of the ink container 51 so as to face upward. Thus, the direction of the flow of ink flowing into the ink container 51 from the inlet opening 53*a* is upward.

In the tank body 41F, the channels 63A and 63C are at the same distance to the outlet opening 59*a* while the channel 63B is at a shorter distance to the outlet opening 59*a* than the channels 63A and 63C are.

Here, in the tank body 41F, in a region near the right side of the outlet opening 59*a*, ink stagnation is not likely to occur at a center portion in the front-rear direction whereas ink stagnation is more likely to occur at a position closer to the front side from the center portion and at a position closer to the rear side from the center portion.

For this reason, in the tank body 41F, the magnitude relation between the widths Wla, Wlb, and Wlc of the channels 63A, 63B, and 63C is set to be Wla=Wlc>Wlb, so that the farther the channel 63 is from the outlet opening 59*a*, the lower the channel resistance is.

Thus, in the tank body 41F too, the flow rate of ink near the right side of the outlet opening 59*a* is made uniform in the front-rear direction, so that ink stagnation is suppressed.

The position of the outlet opening 59*a* and the magnitude relation between the widths of the channels 63 are not limited to the examples described in the first and second embodiments and modifications 1 to 5 of the second embodiment. It suffices that a farther channel 63 from the outlet opening 59*a* has a larger width.

The position of the inlet opening 53*a* and the magnitude relation between the widths of the channels 72 are not limited to the examples described in the second embodiment and its modifications 1 to 5. It suffices that the width of each channel 72 is determined according to the direction and intensity of the flow of ink flowing into the ink container 51 from the inlet opening 53*a* and the distance from the inlet opening 53*a* to the channel 72 such that a channel 72 at a position where ink stagnation is more likely to occur has a larger width.

In the second embodiment and its modifications 1 to 5, the flow regulation walls 62 on the outlet opening 59*a* side and the flow regulation walls 71 on the inlet opening 53*a* side are provided, but the flow regulation walls 62 on the outlet opening 59*a* side may be omitted. Even in this case, the flow regulation walls 71 suppress ink stagnation and therefore improve the ink agitation efficiency.

In the first and second embodiments, examples where the flow regulation walls 62 form three channels 63 have been described. However, the number of channels 63 is not limited to the above and only needs to be two or more. In the second embodiment and its modifications 1 to 5, examples where the flow regulation walls 71 form three channels 72 have been described. However, the number of channels 72 is not limited to the above and only needs to be two or more.

In the first and second embodiments, configurations in which the bottom surface 51*b* of the ink container 51 is inclined have been described. However, the configuration is not limited to the above. For example, the bottom surface 51*b* may be horizontal.

In the first and second embodiments, configurations in which each flow regulation wall 62 (channel formation member) is provided to stand on the bottom surface 51*b* of the ink container 51 have been described. However, there may be a gap between the flow regulation wall 62 and the bottom surface 51*b*. In this case, the flow regulation wall 62 is provided in such a manner as not to be swept away by the flow of ink by, for example, being supported on the lid 42 to be suspended therefrom via a suspending member. The gap between the flow regulation wall 62 and the bottom surface 51*b* is, for example, empirically set at such a size as not to deteriorate the performance of suppressing ink stagnation with the flow regulation wall 62. The same applies to the flow regulation walls 71 in the second embodiment and its modifications.

In the first and second embodiments, cases of agitating an ink whose pigment particles sediment has been described. However, the ink to be agitated is not limited to an ink whose component sediments but may be an ink whose components become separated, for example.

In the first and second embodiments, the tanks 21 configured to store ink have been described. However, the disclosure is applicable also to tanks configured to store liquids other than ink.

The embodiments have the following configurations, for example.

A tank in accordance with some embodiments includes: a liquid container configured to store a liquid; an inlet opening through which the liquid flows into the liquid container; an outlet opening through which the liquid flows out from the liquid container; and a channel formation member arranged between the inlet opening and the outlet opening and configured to form channels. Widths of the channels are such that a channel at a position where stagnation of the liquid is more likely to occur has a larger width.

In the tank in accordance with some embodiments, the channel formation member may include a first channel formation member arranged at a side of the outlet opening and configured to form first channels. Widths of the first channels may be such that a first channel at a longer distance from the outlet opening has a larger width.

The channel formation member may further include a second channel formation member arranged at a side of the inlet opening and configured to form second channels. Each of the second channels may have a width corresponding to a direction and intensity of a flow of the liquid flowing into the liquid container from the inlet opening and a distance from the inlet opening to the second channel.

In the tank in accordance with some embodiments, the channel formation member may include a second channel formation member arranged at a side of the inlet opening and configured to form second channels. Each of the second channels may have a width corresponding to a direction and intensity of a flow of the liquid flowing into the liquid container from the inlet opening and a distance from the inlet opening to the second channel.

The channel formation member may further include a first channel formation member arranged at a side of the outlet opening and configured to form first channels. Widths of the first channels may be such that a first channel at a longer distance from the outlet opening has a larger width.

In the tank in accordance with some embodiments, a height of an upper end of the channel formation member may be equal to or more than a prescribed height depending on a maximum depth of the liquid at a position where the channel formation member is installed, and less than the maximum depth of the liquid at the position where the channel formation member is installed.

A height of an upper end of the first channel formation member may be equal to or more than a prescribed height depending on a maximum depth of the liquid at a position where the first channel formation member is installed, and less than the maximum depth of the liquid at the position where the first channel formation member is installed.

A height of an upper end of the second channel formation member may be equal to or more than a prescribed height depending on a maximum depth of the liquid at a position where the second channel formation member is installed, and less than the maximum depth of the liquid at the position where the second channel formation member is installed.

A height of an upper end of the first channel formation member may be equal to or more than a prescribed height depending on a maximum depth of the liquid at a position where the first channel formation member is installed, and less than the maximum depth of the liquid at the position where the first channel formation member is installed, and a height of an upper end of the second channel formation member may be equal to or more than a prescribed height depending on a maximum depth of the liquid at a position where the second channel formation member is installed, and less than the maximum depth of the liquid at the position where the second channel formation member is installed.

Figure 13:
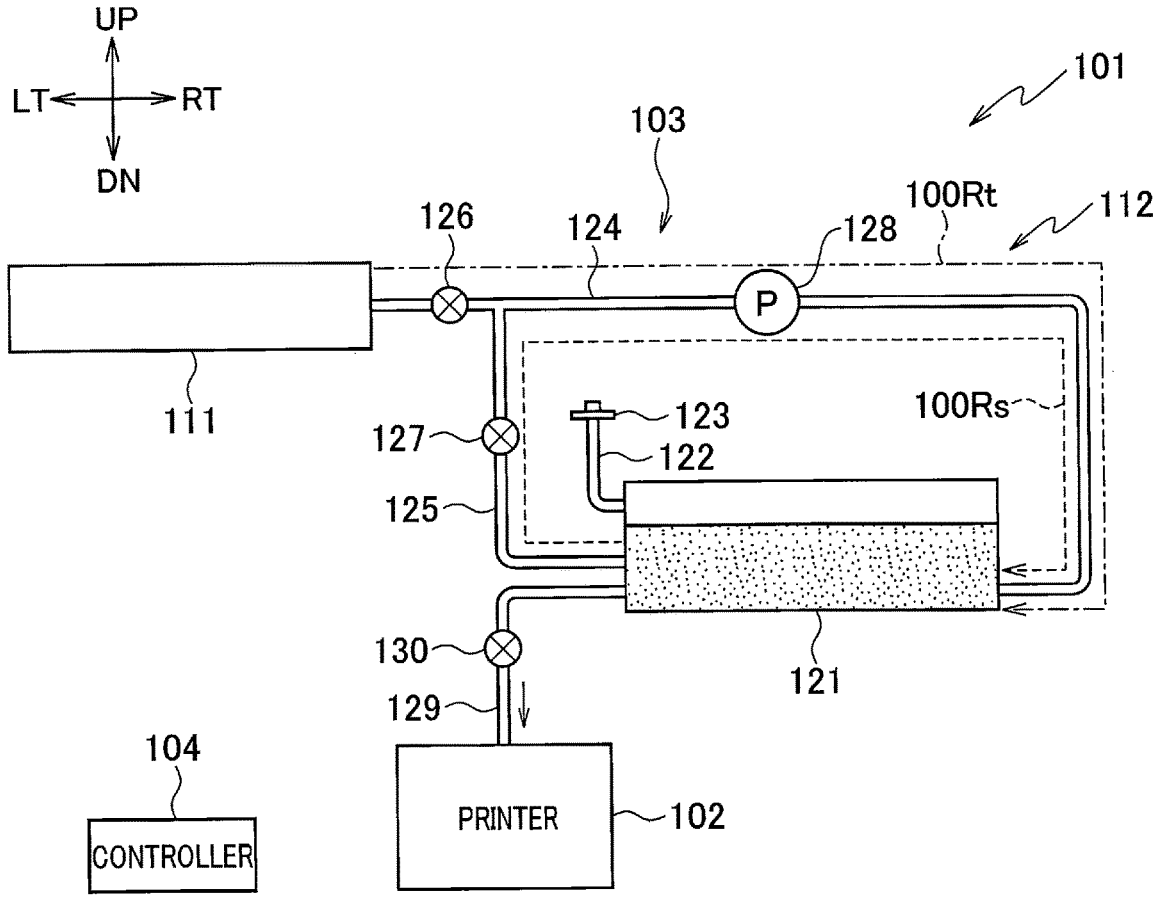
FIG. 13 is a schematic configuration diagram of a printing apparatus provided with a tank according to a third embodiment.
Figure 14:
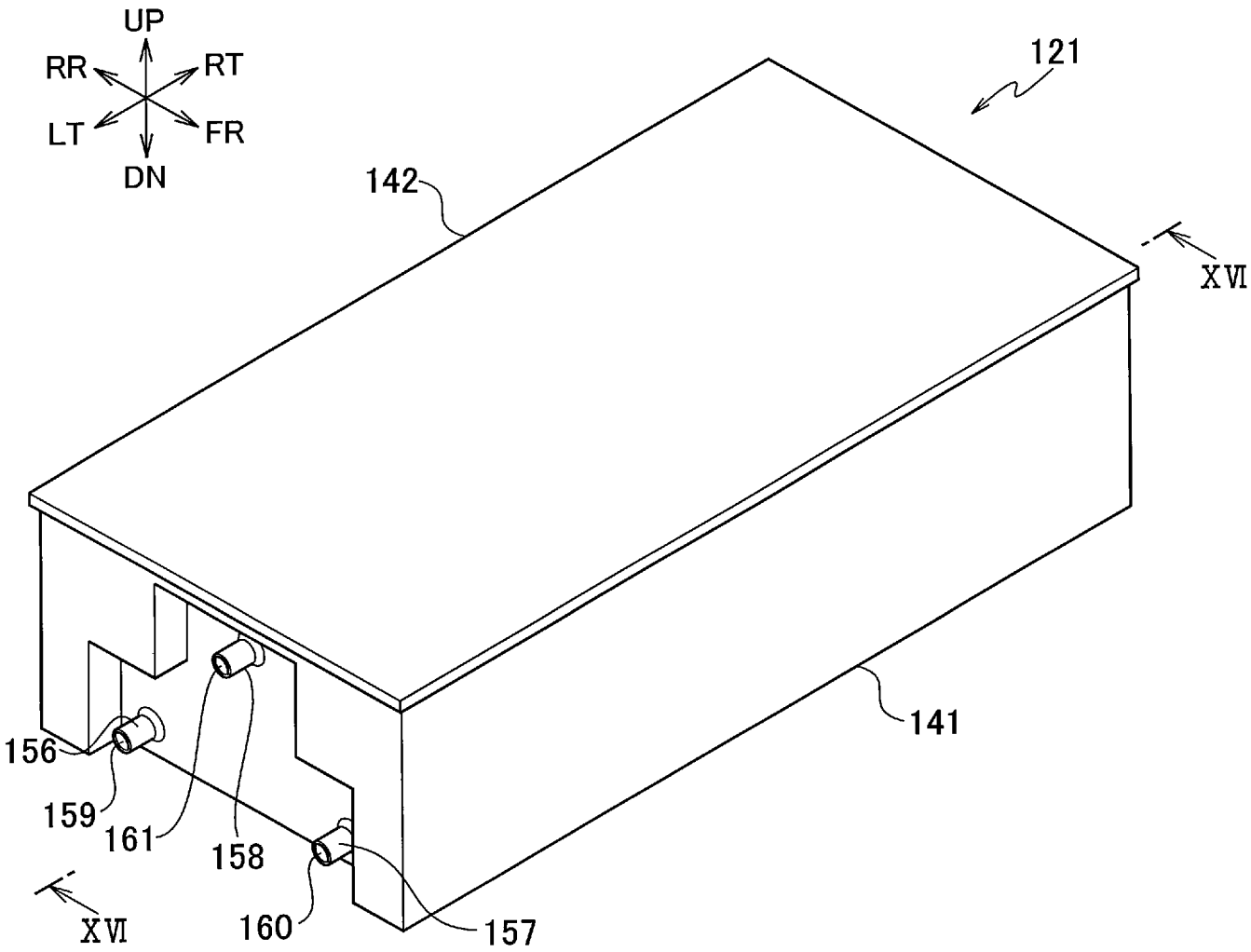
FIG. 14 is a perspective view of the tank according to the third embodiment.
Figure 15:
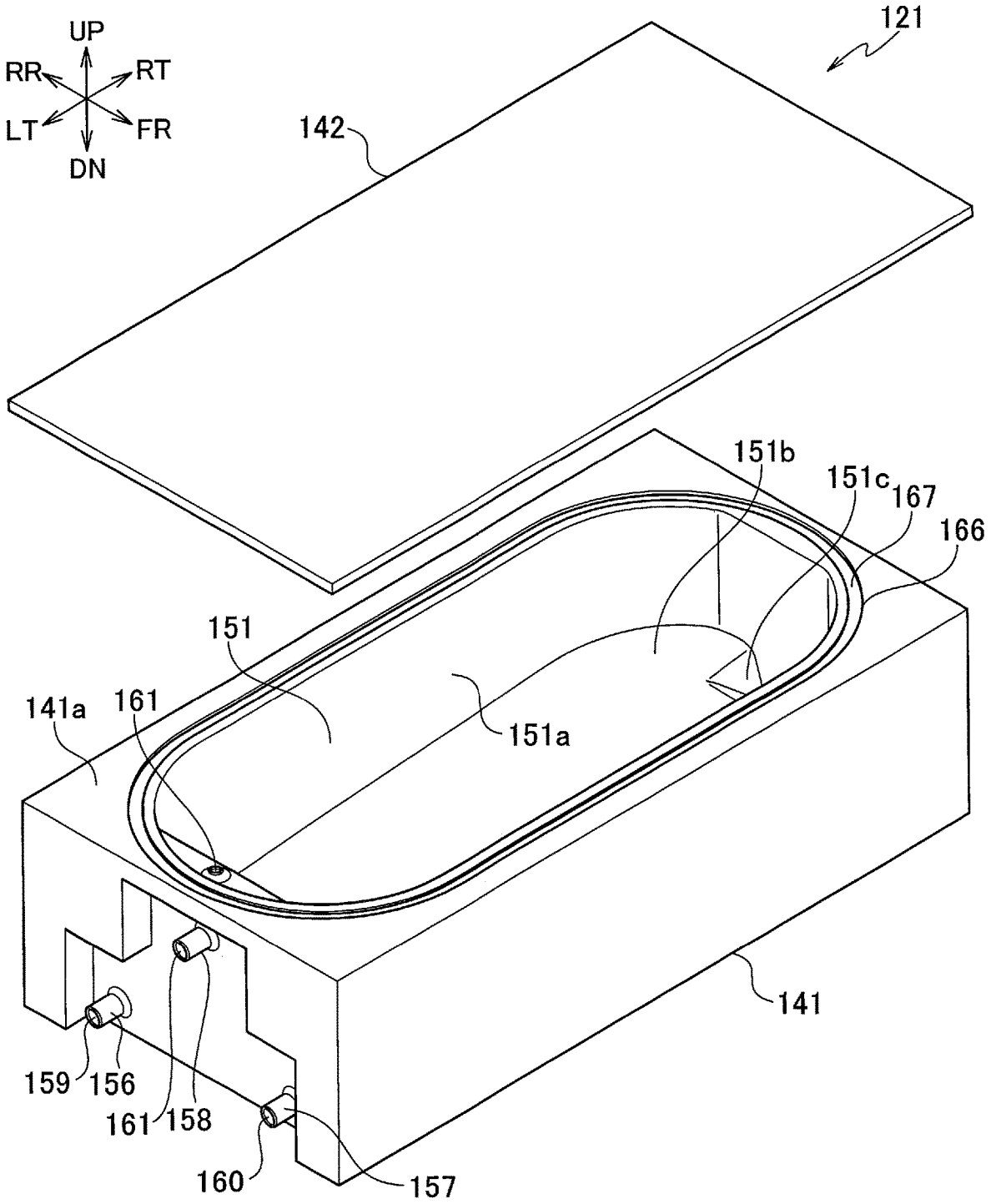
FIG. 15 is an exploded perspective view of the tank according to the third embodiment.
Figure 16:
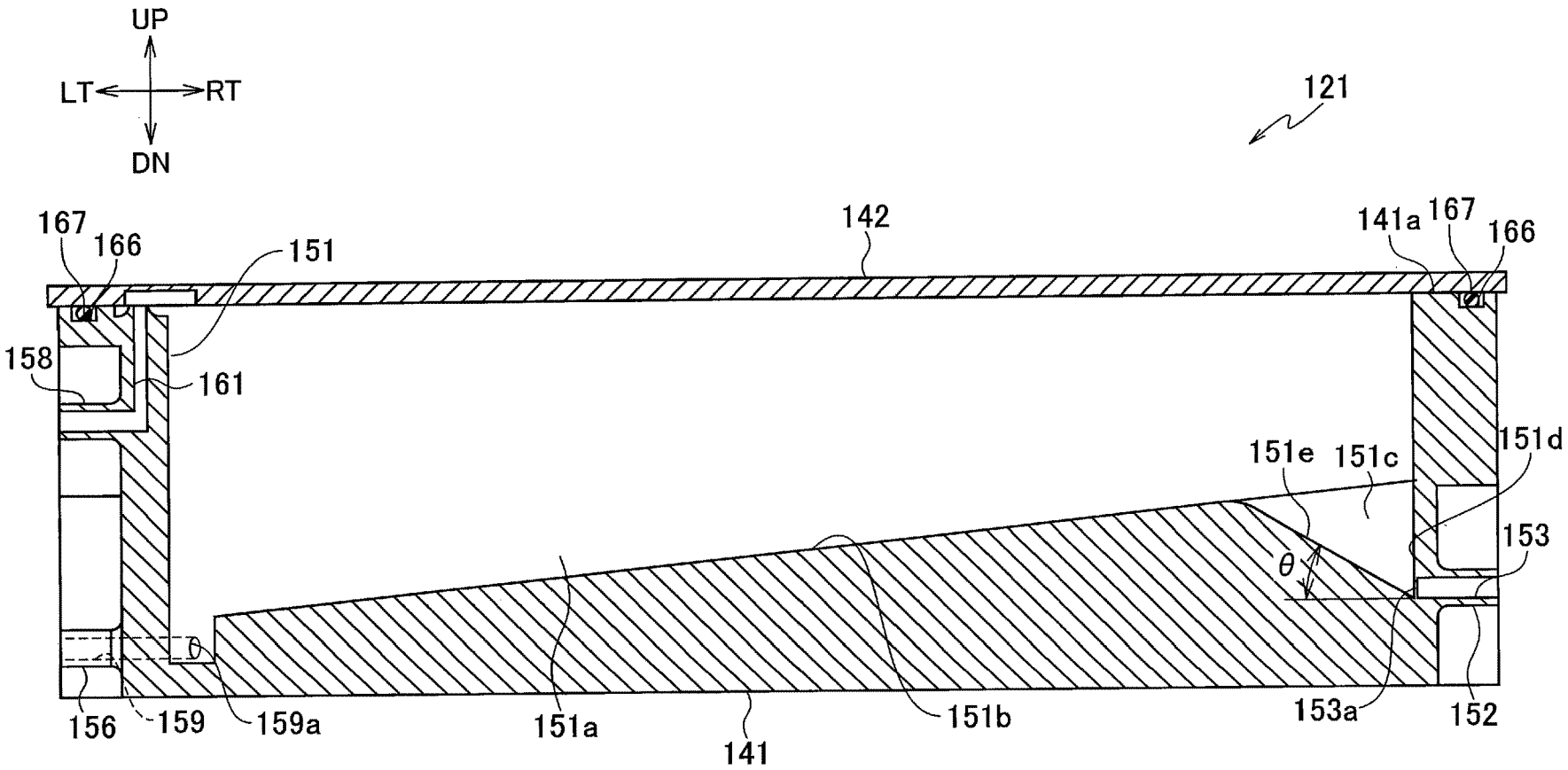
FIG. 16 is a cross-sectional view along line XVI-XVI in FIG. 14.
Figure 17:
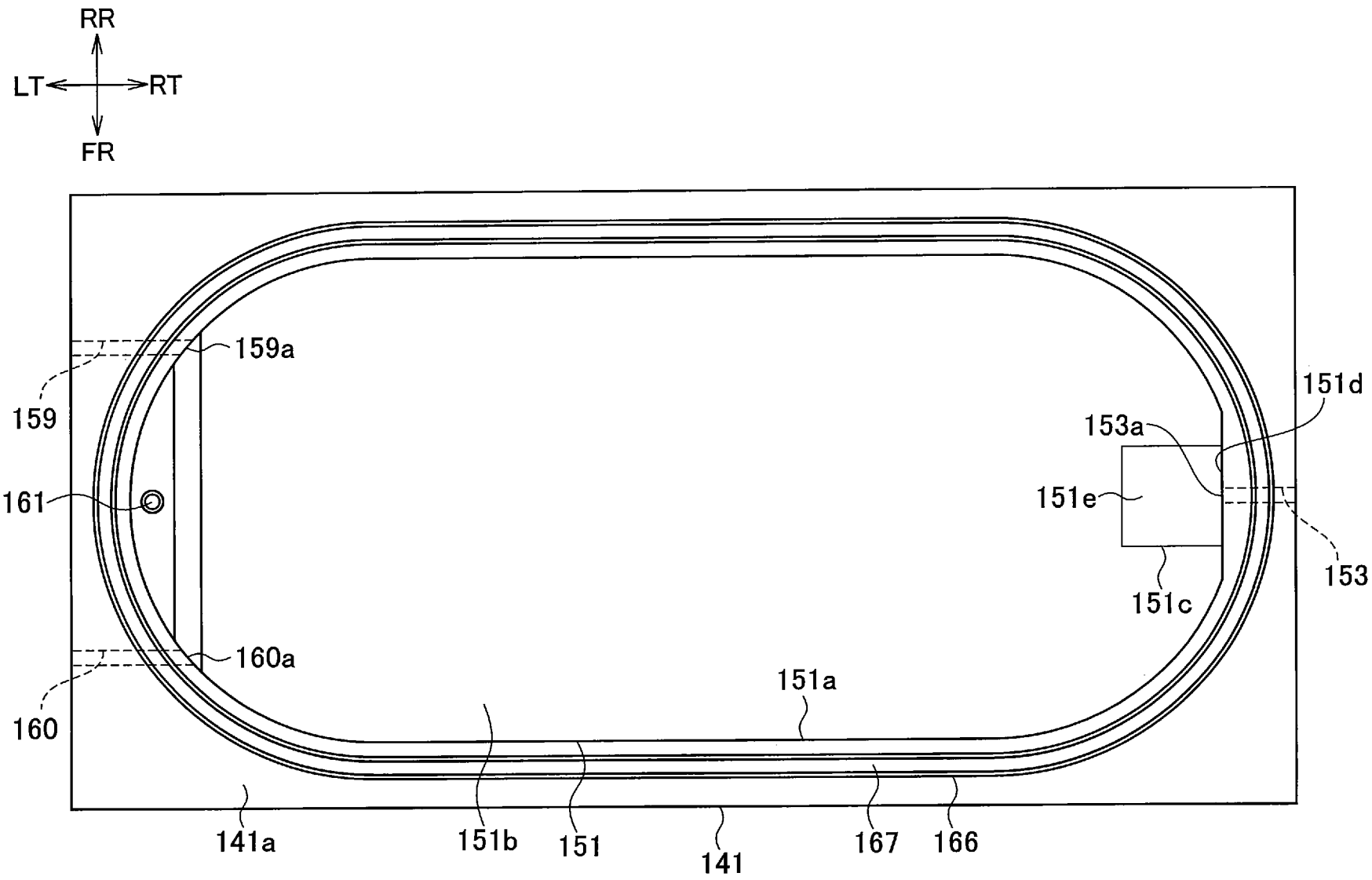
FIG. 17 is a plan view of a tank body according to the third embodiment.

FIG. 13 is a schematic configuration diagram of a printing apparatus 101 provided with a tank 121 according to a third embodiment of the disclosure. FIG. 14 is a perspective view of the tank 121. FIG. 15 is an exploded perspective view of the tank 121. FIG. 16 is a cross-sectional view along line XVI-XVI in FIG. 14. FIG. 17 is a plan view of a tank body 141. Note that in the following description, the direction perpendicular to the sheet surface of FIG. 13 is defined as a front-rear direction, and the front side of the sheet surface is defined as the front side. Also, the up-down and left-right directions of the sheet surface of FIG. 13 are defined as up-down and left-right directions, respectively. Here, the up-down direction illustrated in FIG. 13 is the vertical direction. In FIGS. 13 to 21, the rightward direction, leftward direction, upward direction, downward direction, frontward direction, and rearward direction are denoted as RT, LT, UP, DN, FR, and RR, respectively.

As illustrated in FIG. 13, the printing apparatus 101 according to the third embodiment includes a printer 102, an ink supply unit 103, and a controller 104.

The printer 102 has an inkjet head (not illustrated) and is configured to print an image on a sheet by ejecting ink onto the sheet from the inkjet head.

The ink supply unit 103 is configured to agitate ink and supply the ink to the printer 102. The ink supply unit 103 includes an ink cartridge 111 and an agitator 112.

Here, the ink used for printing in the printing apparatus 101 is a pigment ink, and its pigment particles may sediment if the ink is left unused. For example, the ink used for printing in the printing apparatus 101 is a magnetic ink character reader (MICR) ink containing metallic particles being magnetic bodies. The sedimentation of the pigment particles in the ink causes troubles such as ejection failure at the inkjet head and variation in the concentration of the ejected ink. Since the pigment particles in the ink may have sedimented inside the ink cartridge 111, the printing apparatus 101 agitates the ink in the agitator 112. In this way, if the pigment particles have sedimented, the sedimentation is solved.

The ink cartridge 111 stores the pigment ink being the ink to be used for printing by the printer 102. The ink cartridge 111 is configured to be attachable to and detachable from the printing apparatus 101.

The agitator 112 is configured to obtain ink from the ink cartridge 111 and agitate the obtained ink. The agitator 112 is configured to supply the agitated ink to the printer 102. The agitator 112 includes the tank 121, an atmosphere opening pipe 122, an air filter 123, an ink transfer pipe 124, an ink outlet pipe 125, an ink transfer valve 126, an agitation valve 127, a pump 128, an ink supply pipe 129, and an ink supply valve 130.

The tank 121 is configured to store the ink obtained from the ink cartridge 111 to agitate it. Details of the tank 121 will be described later.

The atmosphere opening pipe 122 forms an air channel for opening the tank 121 to the atmosphere. The atmosphere opening pipe 122 is connected at one end to the tank 121 and communicates at the other end with the atmosphere through the air filter 123. The air filter 123 is configured to prevent dust and the like in the air from entering the atmosphere opening pipe 122.

The ink transfer pipe 124 is configured to connect the ink cartridge 111 and the tank 121. The ink transfer pipe 124 forms a transfer route 100Rt being a route through which to transfer ink from the ink cartridge 111 to the tank 121.

The ink outlet pipe 125 is configured to connect the tank 121 and the ink transfer pipe 124.

The ink outlet pipe 125 and the portion of the ink transfer pipe 124 on the tank 121 side from the point to which the ink outlet pipe 125 is connected form an agitation route 100Rs. The agitation route 100Rs is a route through which to circulate the ink in the tank 121 to agitate it.

The ink transfer valve 126 is configured to open and close the ink channel in the ink transfer pipe 124. The ink transfer valve 126 is arranged at the portion of the ink transfer pipe 124 on the ink cartridge 111 side from the point to which the ink outlet pipe 125 is connected.

The agitation valve 127 is configured to open and close the ink channel in the ink outlet pipe 125.

The ink transfer valve 126 and the agitation valve 127 switch the route to be opened between the transfer route 100Rt and the agitation route 100Rs. Specifically, by opening the ink transfer valve 126 and closing the agitation valve 127, the printing apparatus 101 is brought into a state where the transfer route 100Rt is opened and the agitation route 100Rs is closed. By closing the ink transfer valve 126 and opening the agitation valve 127, the printing apparatus 101 is brought into a state where the agitation route 100Rs is opened and the transfer route 100Rt is closed.

The pump 128 is configured to move ink such that ink flows out from the tank 121 and flows back into the tank 121 through the agitation route 100Rs to thereby agitate the ink in the tank 121. The pump 28 is also used to transfer ink from the ink cartridge 111 to the tank 121. The pump 128 is arranged at the overlapping portion of the transfer route 100Rt and the agitation route 100Rs. Specifically, the pump 128 is arranged at the portion of the ink transfer pipe 124 on the tank 121 side from the point to which the ink outlet pipe 125 is connected.

The ink supply pipe 129 is configured to connect the tank 121 and the printer 102.

The ink supply valve 130 is configured to open and close the ink channel in the ink supply pipe 129. By opening the ink supply valve 130, ink is supplied from the tank 121 to the printer 102.

The controller 104 is configured to control the operations of components in the printing apparatus 101. The controller 104 includes a CPU, an RAM, an ROM, a hard disk drive, and so on.

Next, details of the tank 121 will be described.

The tank 121 includes the tank body 141 and a lid 142.

The tank body 141 is configured to store ink transferred from the ink cartridge 111. The tank body 141 is formed in a substantially cuboidal shape.

The tank body 141 has an ink container 151 (liquid container). The ink container 151 is a portion configured to store ink (liquid). The ink container 151 is formed by recessing an upper surface 141*a* of the tank body 141, and has a peripheral wall 151*a* and a bottom surface 151*b*.

A peripheral wall 151*a* of the ink container 151 is formed in a substantially oval shape elongated in the left-right direction in a plan view. Specifically, the peripheral wall 151*a* has curved portions at a left end portion and a right end portion of the ink container 151. This makes it easier for ink to flow from a later-described inlet opening 153*a* side (right side) to a later-described outlet opening 159*a* side (left side) and thus improves the ink agitation efficiency.

The bottom surface 151*b* of the ink container 151 is inclined downward toward the left side. Specifically, the bottom surface 151*b* is inclined to be lower from the inlet opening 153*a* side (right side) to the outlet opening 159*a* side (left side). This makes it easier for ink to flow from the inlet opening 153*a* side to the outlet opening 159*a* side and thus improves the ink agitation efficiency.

A recess 151*c* is formed in a right end portion of the bottom surface 151*b*. The recess 151*c* is formed by recessing the bottom surface 151*b*. In this manner, ink is accumulated in the recess 151*c* even when the volume of ink inside ink container 151 is low. The inlet opening 153*a* is open at the recess 151*c*. Specifically, the inlet opening 153*a* is open at a lower end portion of the right wall 151*d* of the recess 151*c* so as to face leftward. The right wall 151*d* of the recess 151*c* is formed as part of the peripheral wall 151*a*.

In the recess 151*c*, an inclined portion 151*e* is formed which becomes higher from the inlet opening 153*a* side (right side) to the outlet opening 159*a* side (left side). The inclined portion 151*e* is formed to be higher toward the left side from the lower end of the right wall 151*d* of the recess 151*c*. In this manner, ink having flowed in from the inlet opening 153*a* is guided to flow obliquely upward toward the left side.

An inclination angle θ of the inclined portion 151*e* is set at such an angle that ink flows sufficiently even in an upper left region inside the ink container 151 and ink stagnation does not occur in the upper left region. The inclination angle θ of the inclined portion 151*e* is set according to the viscosity of ink, the flow rate of ink flowing in from the inlet opening 153*a*, and so on and is set in the range of 30° to 60°, for example.

The size of the recess 151*c* in a plan view (the length in the front-rear direction and the length in the left-right direction) and the depth of the recess 151*c* are set according to the viscosity of ink, the flow rate of ink flowing in from the inlet opening 153*a*, and so on such that ink will not splash when ink flows in.

An ink inlet port 152 is provided on a right side portion of the tank body 141. The ink inlet port 152 is configured to connect the ink transfer pipe 124 to the tank body 141. An ink inlet hole 153 is formed in the ink inlet port 152.

The ink inlet hole 153 is open at one end in the ink inlet port 152 and is open at the other end to the ink container 151. Thus, the ink inlet hole 153 communicates with the ink container 151, so that ink flows in from the ink transfer pipe 124 to the ink container 151 through the ink inlet hole 153. The opening of the ink inlet hole 153 at the ink container 151 is the inlet opening 153*a*, through which ink is caused to flow into the ink container 151. The inlet opening 153*a* is arranged at a lower end portion of the recess 151*c*. Specifically, the inlet opening 153*a* is open at the lower end portion of the right wall 151*d* of the recess 151*c* in the ink container 151 so as to face leftward.

An ink outlet port 156, an ink supply port 157, and an atmosphere opening port 158 are provided on a left side portion of the tank body 141.

The ink outlet port 156 is configured to connect the ink outlet pipe 125 to the tank body 141. An ink outlet hole 159 is formed in the ink outlet port 156.

The ink outlet hole 159 is open at one end in the ink outlet port 156 and is open at the other end to a lower portion of the peripheral wall 151*a* of the ink container 151. Thus, the ink outlet hole 159 communicates with the ink container 151, so that ink flows out from a lower portion of the ink container 151 to the ink outlet pipe 125 through the ink outlet hole 159. The opening of the ink outlet hole 159 at the ink container 151 is the outlet opening 159*a*, through which ink is caused to flow out from the ink container 151 to the ink outlet pipe 125. The outlet opening 159*a* is arranged at the left end portion of the ink container 151 on the rear side relative to the center of the ink container 151 in the front-rear direction.

The ink supply port 157 is configured to connect the ink supply pipe 129 to the tank body 141. An ink supply hole 160 is formed in the ink supply port 157.

The ink supply hole 160 is open at one end in the ink supply port 157 and is open at the other end to a lower portion of the peripheral wall 151*a* of the ink container 151. Thus, the ink supply hole 160 communicates with the ink container 151, so that ink flows out from the ink container 151 to the ink supply pipe 129 through the ink supply hole 160. The opening of the ink supply hole 160 at the ink container 151 is a supply opening 160*a* through which ink is supplied from the ink container 151 to the printer 102 via the ink supply pipe 129. The supply opening 160*a* is arranged at the left end portion of the ink container 151 on the front side relative to the center of the ink container 151 in the front-rear direction.

The atmosphere opening port 158 is configured to connect the atmosphere opening pipe 122 to the tank body 141. An atmosphere communication hole 161 is formed in the atmosphere opening port 158. The atmosphere communication hole 161 allows the internal space of the tank body 141 covered by the lid 142 (ink container 151) to communicate with the atmosphere to thereby open the tank 121 to the atmosphere. The atmosphere communication hole 161 is open at one end in the atmosphere opening port 158 and is open at the other end to an upper surface 141*a* of the tank body 141.

A seal groove 166 is formed in the tank body 141. The seal groove 166 is formed to surround the ink container 151. The seal groove 166 is a groove in which to install a seal member 167. The seal member 167 is a member configured to prevent leakage of the ink in the ink container 151 from the tank 121.

The lid 142 is configured to cover the top of the tank body 141. The lid 142 is placed on the upper surface 141*a* of the tank body 141.

Next, a description will be given of the operation of transferring ink from the ink cartridge 111 to the tank 131 and the operation of agitating ink in the agitator 112 in the printing apparatus 101.

When a sensor (not illustrated) detects that the level of the ink in the tank 121 has reached a predetermined lower limit level or lower, ink is transferred from the ink cartridge 111 to the tank 121.

In doing so, the controller 104 opens the ink transfer valve 126 and closes the agitation valve 127. As a result, the printing apparatus 101 is brought into the state where the transfer route 100Rt is opened and the agitation route 100Rs is closed. Meanwhile, the printing apparatus 101 is equipped with a new ink cartridge 111.

Then, the controller 104 starts driving the pump 128. As a result, ink is transferred from the ink cartridge 111 to the tank 121 through the transfer route 100Rt.

After the ink in the ink cartridge 111 is all transferred to the tank 121, the controller 104 closes the ink transfer valve 126 and opens the agitation valve 127. As a result, the printing apparatus 101 is switched to the state where the agitation route 100Rs is opened and the transfer route 100Rt is closed. Ink is then circulated along the agitation route 100Rs, so that the ink in the tank 121 is agitated.

After the elapse of a prescribed time since the start of the agitation of the ink in the tank 121, the controller 104 stops the pump 128 and closes the agitation valve 127. As a result, the ink agitation operation by the agitator 112 is finished.

When the printer 102 performs printing, ink transferred to the tank 121 and agitated in the above manner is supplied to the printer 102 as necessary.

The agitation operation in the agitator 112 is performed not only immediately after the above-described ink transfer from the ink cartridge 111 to the tank 121 but also at regular intervals of a predetermined time, for example, in order to prevent sedimentation of the pigment particles in the ink in the tank 121.

Figure 18:
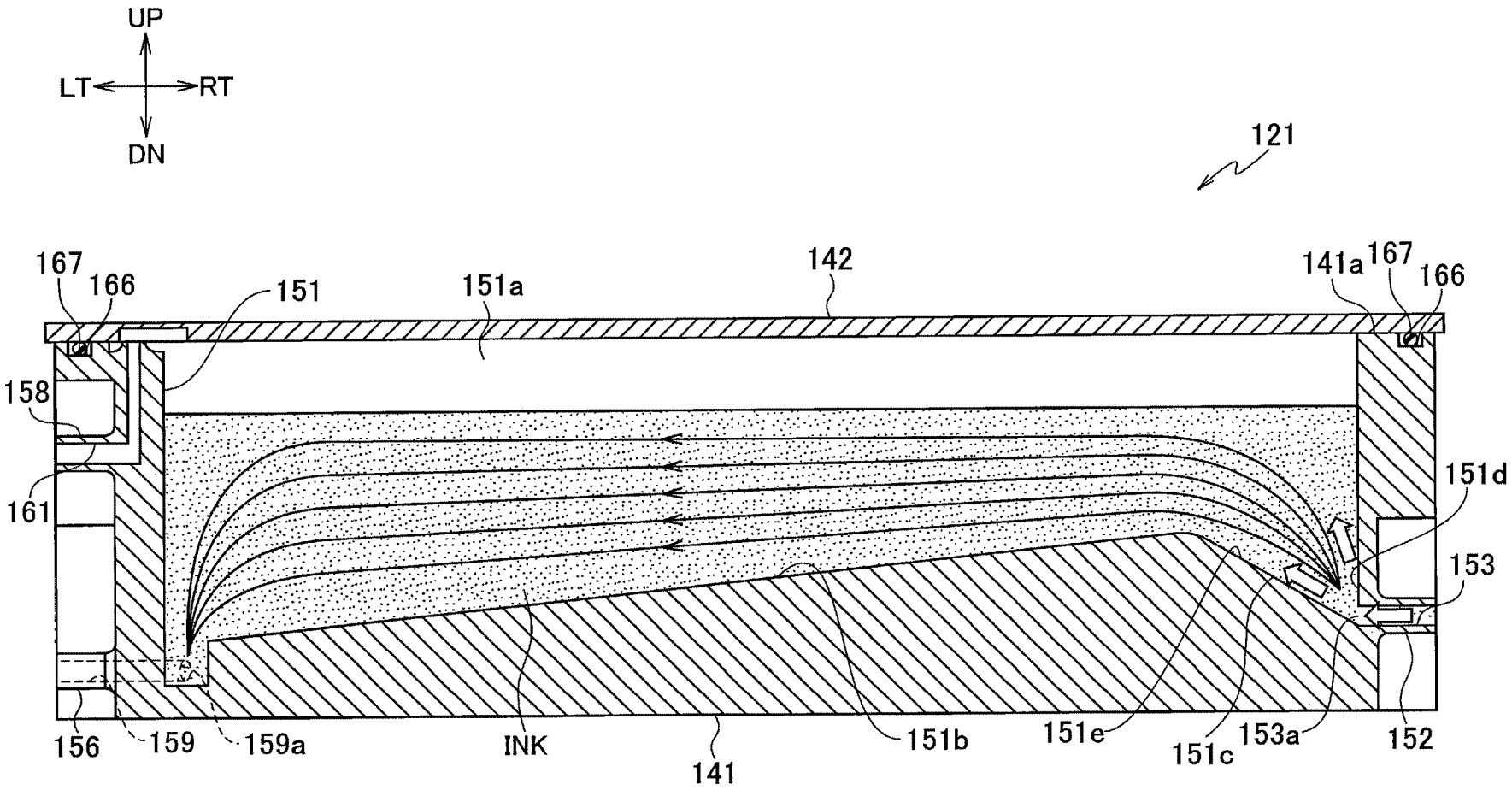
FIG. 18 is an explanatory diagram of the flow of ink in the tank during an agitation operation according to the third embodiment.

As illustrated in FIG. 18, during the above-described agitation operation, ink having flowed into the ink container 151 from the inlet opening 153*a* is guided by the inclined portion 151*e* of the recess 151*c* to flow obliquely upward toward the left side. The ink then flows through the ink container 151 toward the left side and flows out from the outlet opening 159*a*.

Here, consider a configuration in which, unlike the third embodiment, the inlet opening 153*a* is open to face upward and the inclined portion 151*e* is not formed, so that ink flows upward into the ink container 151 from the inlet opening 153*a*. In this case, the inflow hardly generates a leftward flow. While an ink flow is generated by the sucking of ink from the outlet opening 159*a*, this flow is strong in a lower portion of the ink container 151 but weak in an upper portion. For this reason, ink stagnation is likely to occur in an upper region of the left side (outlet opening 159*a* side) of the ink container 151. This lowers the ink agitation efficiency.

On the other hand, in the third embodiment, ink having flowed in from the inlet opening 153*a* is guided by the inclined portion 151*e* to flow obliquely upward toward the left side, as described above. Thus, an ink flow is generated also in the upper region of the left side of the ink container 151. This suppresses ink stagnation and thus enables efficient ink agitation.

As mentioned above, the agitation operation may be performed at times other than immediately after ink transfer from the ink cartridge 111 to the tank 121. Thus, ink is sometimes caused to flow into the ink container 151 from the inlet opening 153*a* by the agitation operation in a state where the volume of ink inside the ink container 151 is low.

Figure 19:
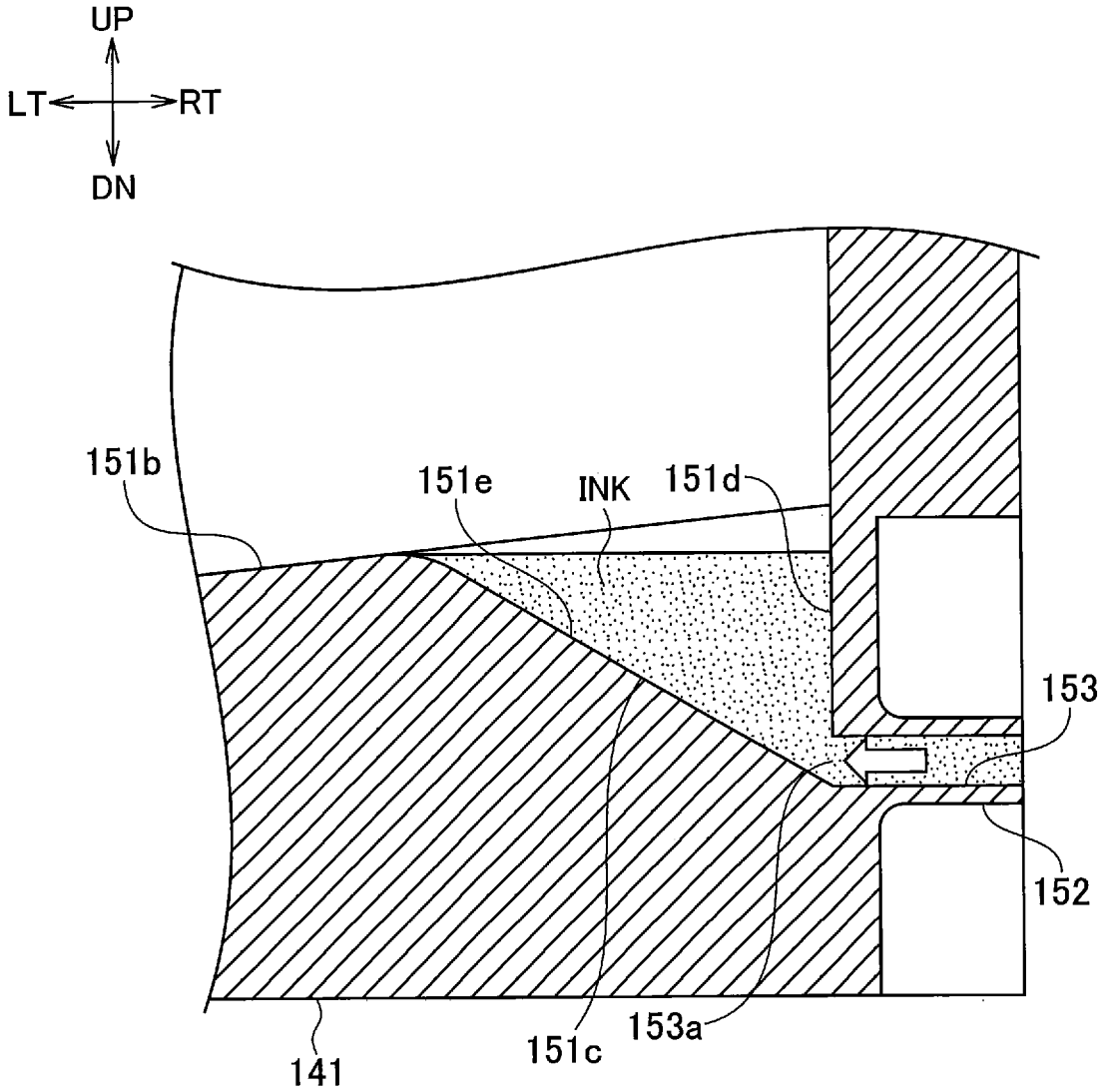
FIG. 19 is an explanatory diagram of a state where ink is accumulated in a recess in an ink container according to the third embodiment.

Here, in the tank 121, even when the volume of ink inside the ink container 151 is low, ink is accumulated in the recess 151*c*, as illustrated in FIG. 19, for example. When the agitation operation is performed in this state, ink flows in from the inlet opening 153*a* within ink. This suppresses the splashing of ink when ink flows in.

When ink is transferred from the ink cartridge 111 to the tank 121 with the level of the ink inside the tank 121 having reached the lower limit level or lower, the ink also flows in from the inlet opening 153*a* within ink as illustrated in FIG. 19. This suppresses the splashing of ink when ink flows in.

Here, consider a configuration in which, unlike the third embodiment, ink flows in with the inlet opening 153*a* being exposed from ink. In this case, ink may splash when, for example, the ink flowing in drops onto the ink surface.

When ink splashes, air bubbles may be mixed into the ink. The entry of air bubbles into the ink may cause ink ejection failure at the inkjet head of the printer 102. When ink splashes, the ink may attach to the lid 142. When ink attaches to the lid 142, the ink may enter the atmosphere communication hole 161 from the lid 142 and prevent the tank 121 from being open to the atmosphere.

On the other hand, in the third embodiment, even when the volume of ink inside the ink container 151 is low, ink is accumulated in the recess 151*c*, as mentioned above. This suppresses the splashing of ink when ink flows in.

As described above, in the printing apparatus 101, the recess 151*c* is formed in the bottom surface 151*b* of the ink container 151 of the tank 121, and the inlet opening 153*a* is open at the recess 151*c*. Thus, ink flows into the ink container 151 from the inlet opening 153*a* within ink. This reduces the splashing of ink when ink flows in.

Since the recess 151*c* has the inclined portion 151*e*, ink flowing in from the inlet opening 153*a* is guided to flow obliquely upward toward the left side, i.e., a region above the outlet opening 159*a*. This suppresses ink stagnation during the agitation operation. As a result, the ink agitation efficiency is improved.

The inlet opening 153*a* is arranged at a lower end portion of the recess 151*c*. This prevents a situation where ink flowing in from the inlet opening 153*a* disturbs the surface of the ink accumulated in the recess 151*c* and ink splashes. This further reduces the splashing of ink flowing into the ink container 151.

Note that in the third embodiment, a configuration in which the inlet opening 153*a* is open to face leftward, that is, open to face toward the outlet opening 159*a* has been described. However, the inlet opening 153*a* may be open to face upward. Even in this case, the inclined portion 151*e* causes the direction of ink having flowed in from the inlet opening 153*a* to spread obliquely upward toward the left side and thereby suppresses ink stagnation.

In the third embodiment, a configuration in which the inlet opening 153*a* is arranged at the lower end portion of the recess 151*c* has been described. However, the position of the inlet opening 153*a* in the recess 151*c* is not limited to the above position. For example, the inlet opening 153*a* may be arranged at an upper end portion of the recess 151*c*.

In the third embodiment, a configuration in which the bottom surface 151*b* of the ink container 151 is inclined has been described. However, the bottom surface 151*b* may be horizontal. The inclined portion 151*e* is not limited to a planar surface but may be formed as a curved surface at least partly.

In the third embodiment, a case of agitating an ink whose pigment particles sediment has been described. However, the ink to be agitated is not limited to an ink whose component sediments but may be an ink whose components become separated, for example.

In the third embodiment, the tanks 121 configured to store ink have been described. However, the disclosure is applicable also to tanks configured to store liquids other than ink.

Figure 20:
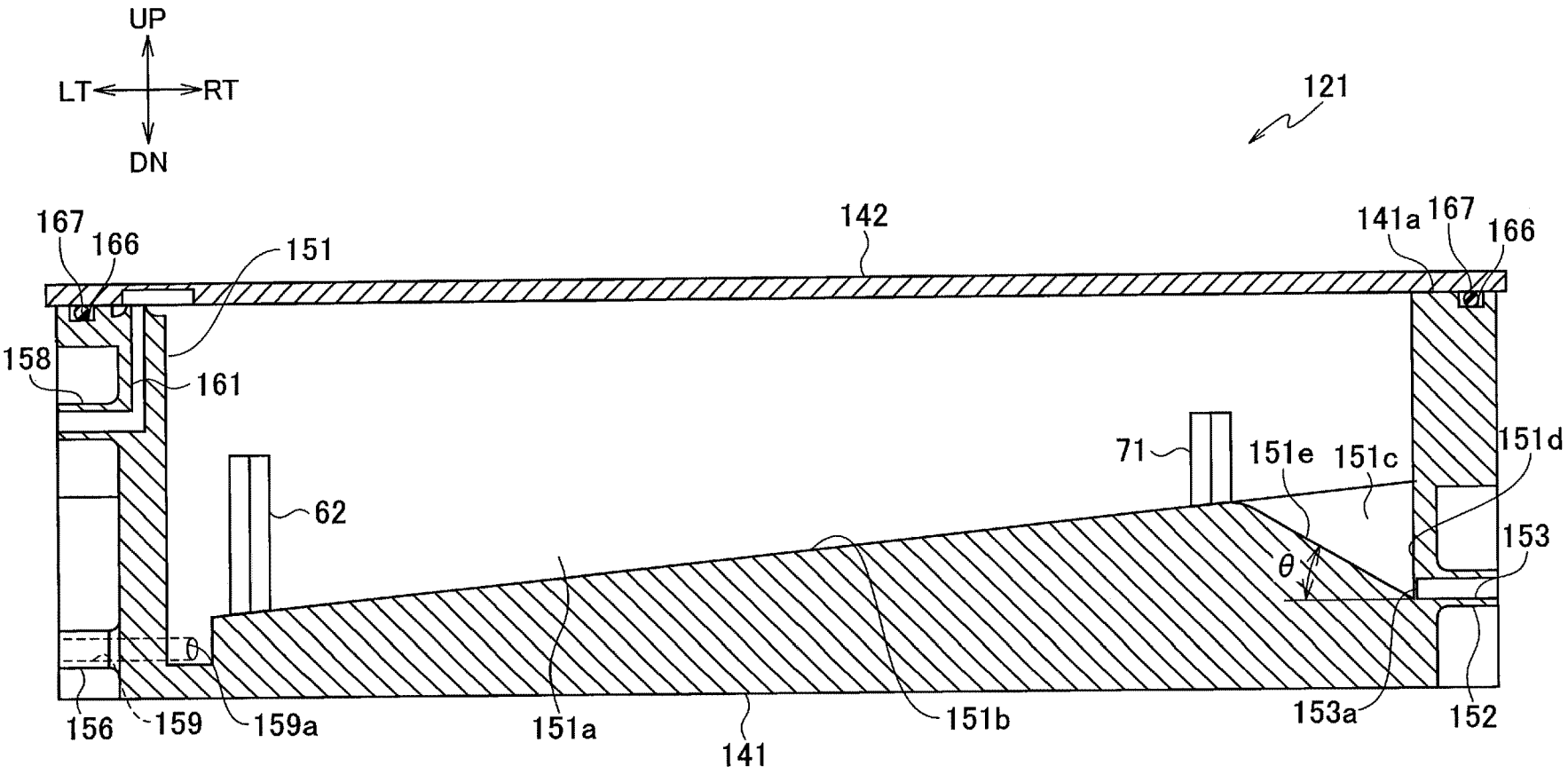
FIG. 20 is a cross-sectional view of a tank according to a modification of the third embodiment along line XVI-XVI in FIG. 14.
Figure 21:
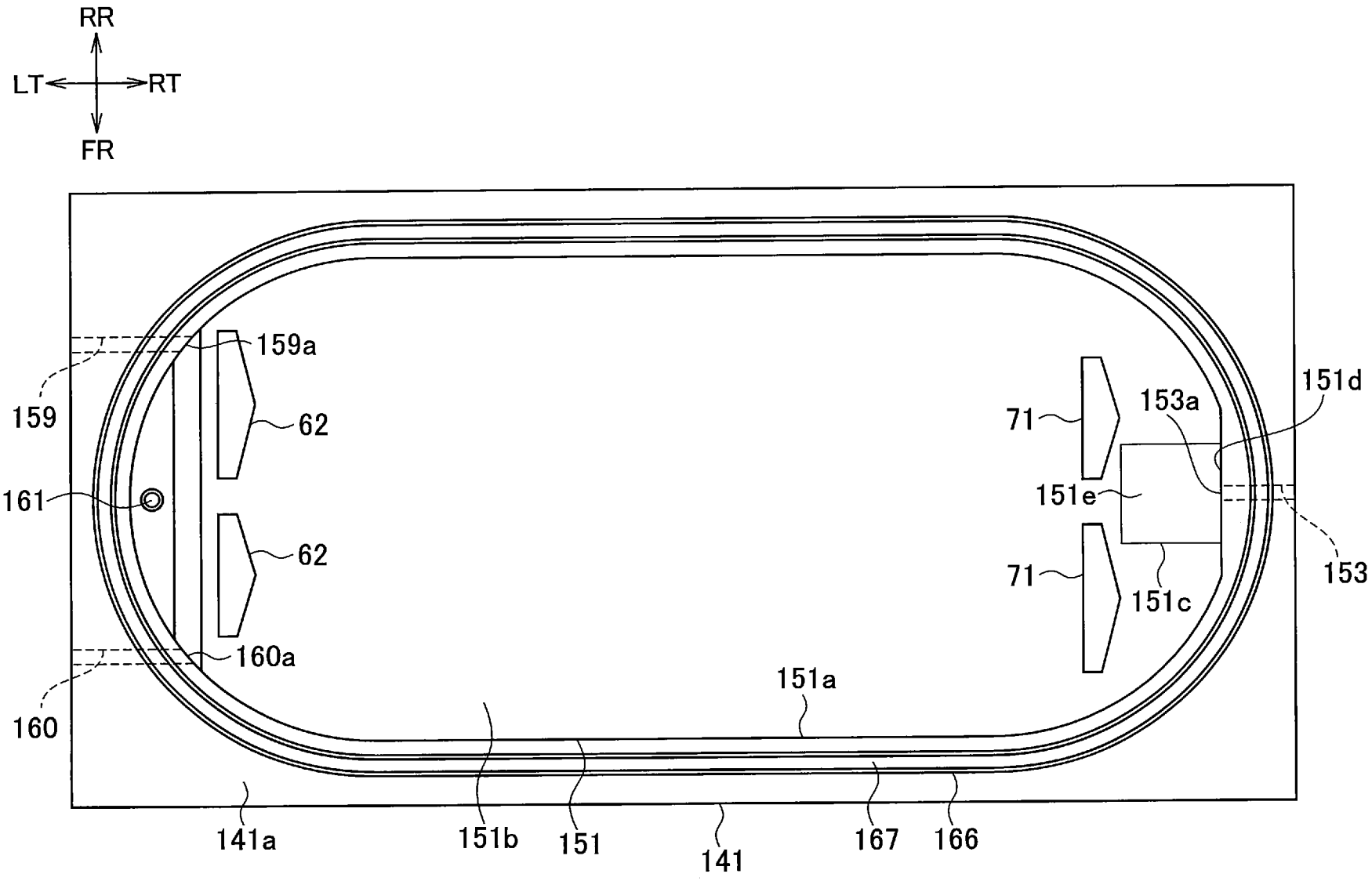
FIG. 21 is a plan view of a tank body according to the modification of the third embodiment.

The first embodiment or the second embodiment (including the modifications) may be applied to the tank 121 in the third embodiment. The tanks 21 in the first embodiment and the second embodiment (including the modifications) may employ the recess 151*c* in the third embodiment. For example, the flow regulation walls 62 and/or the flow regulation walls 71 may be further provided in the tank 121 in the third embodiment to form a plurality of channels. In one example, as illustrated in FIGS. 20 and 21, the flow regulation walls 62 may be provided on a portion of the bottom surface 151*b* on the right side of the outlet opening 159*a*, and the flow regulation walls 71 may be provided on a portion of the bottom surface 151*b* on the left side of the recess 151*c* (inclined portion 151*e*). The combination of the tank 121 in the third embodiment and the first embodiment or the second embodiment (including the modifications) is not limited to the above manner. Any combination is possible as long as the advantageous effects of the embodiments can be achieved.

The embodiment has the following configurations, for example.

A tank in accordance with some embodiments includes a liquid container configured to store a liquid, and an inlet opening through which the liquid flows into the liquid container. The liquid container has a recess which is formed in a bottom surface of the liquid container and at which the inlet opening is open.

The tank may further include an outlet opening through which the liquid flows out from the liquid container. The recess may have an inclined portion which becomes higher from the inlet opening side to the outlet opening side.

The inlet opening may be arranged at a lower end portion of the recess.

Figure 22:
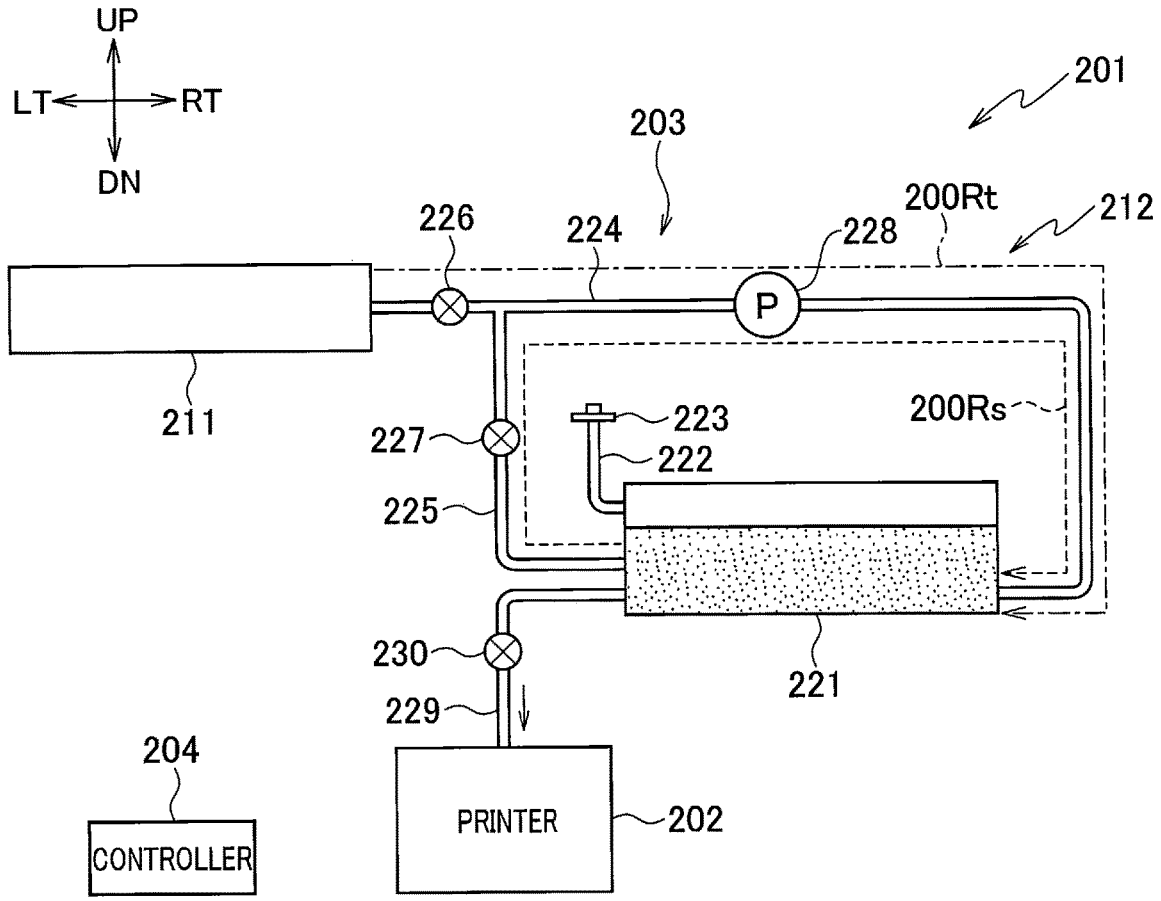
FIG. 22 is a schematic configuration diagram of a printing apparatus provided with a tank according to a fourth embodiment.
Figure 23:
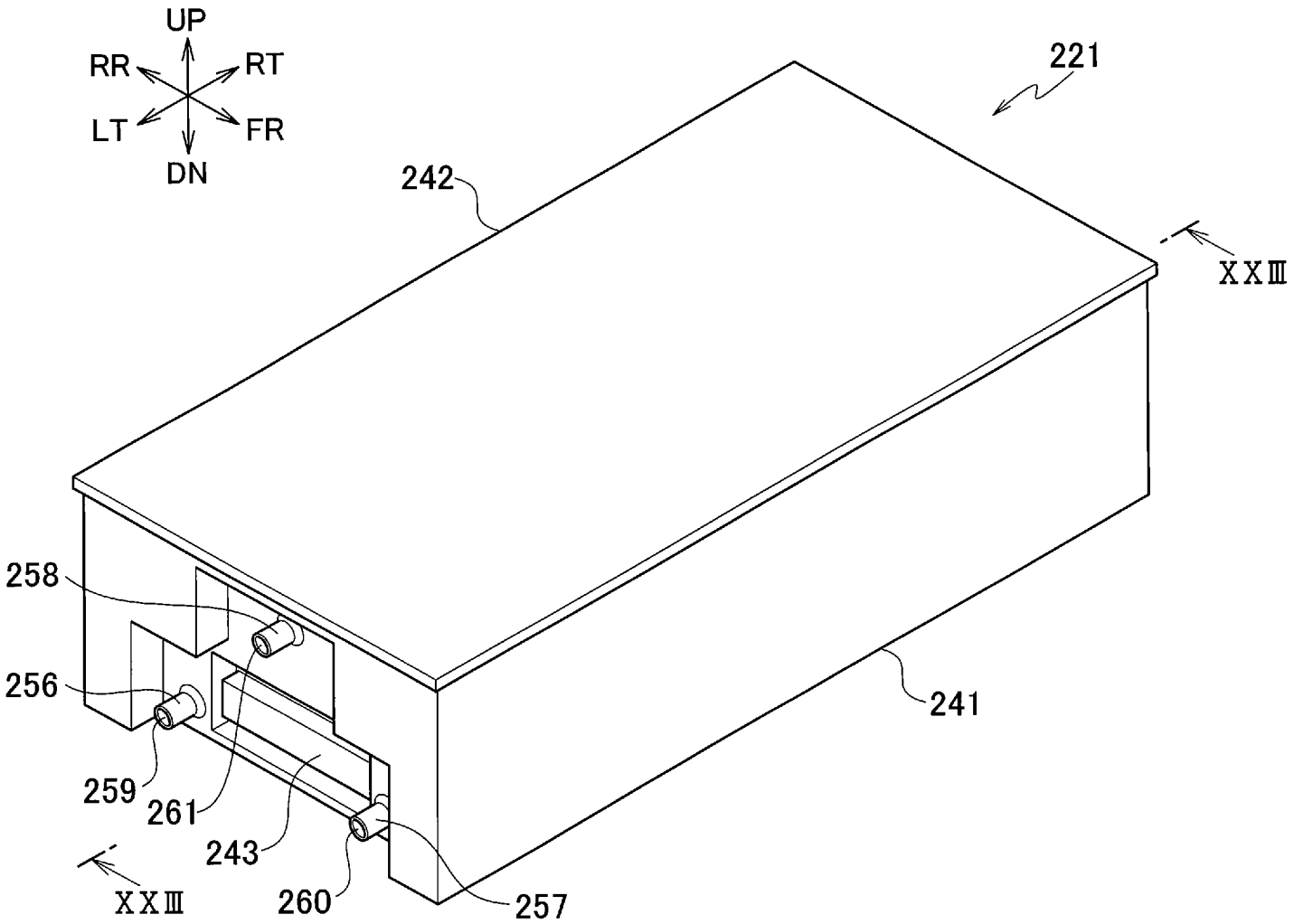
FIG. 23 is a perspective view of the tank according to the fourth embodiment.
Figure 24:
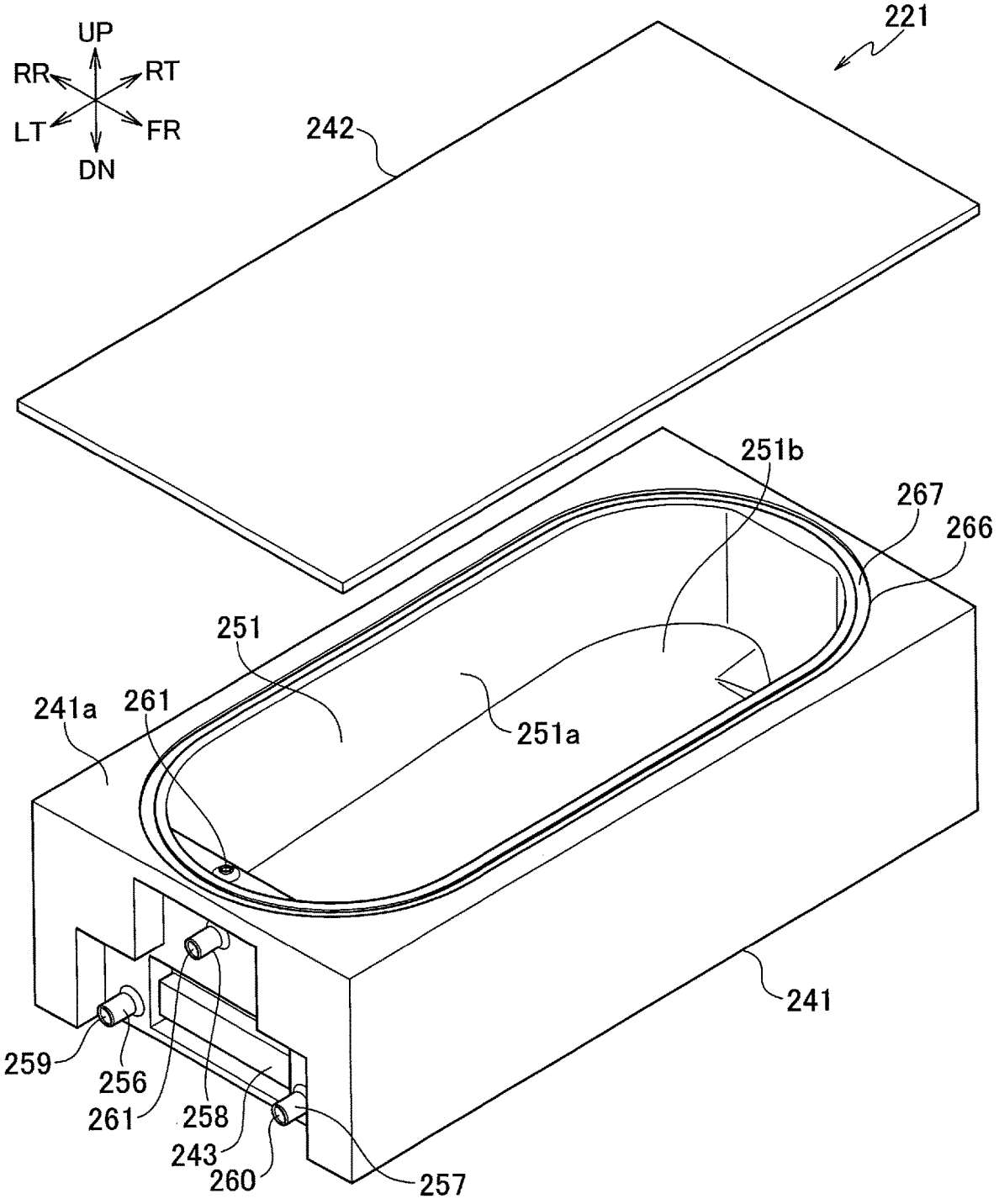
FIG. 24 is an exploded perspective view of the tank according to the fourth embodiment.
Figure 25:
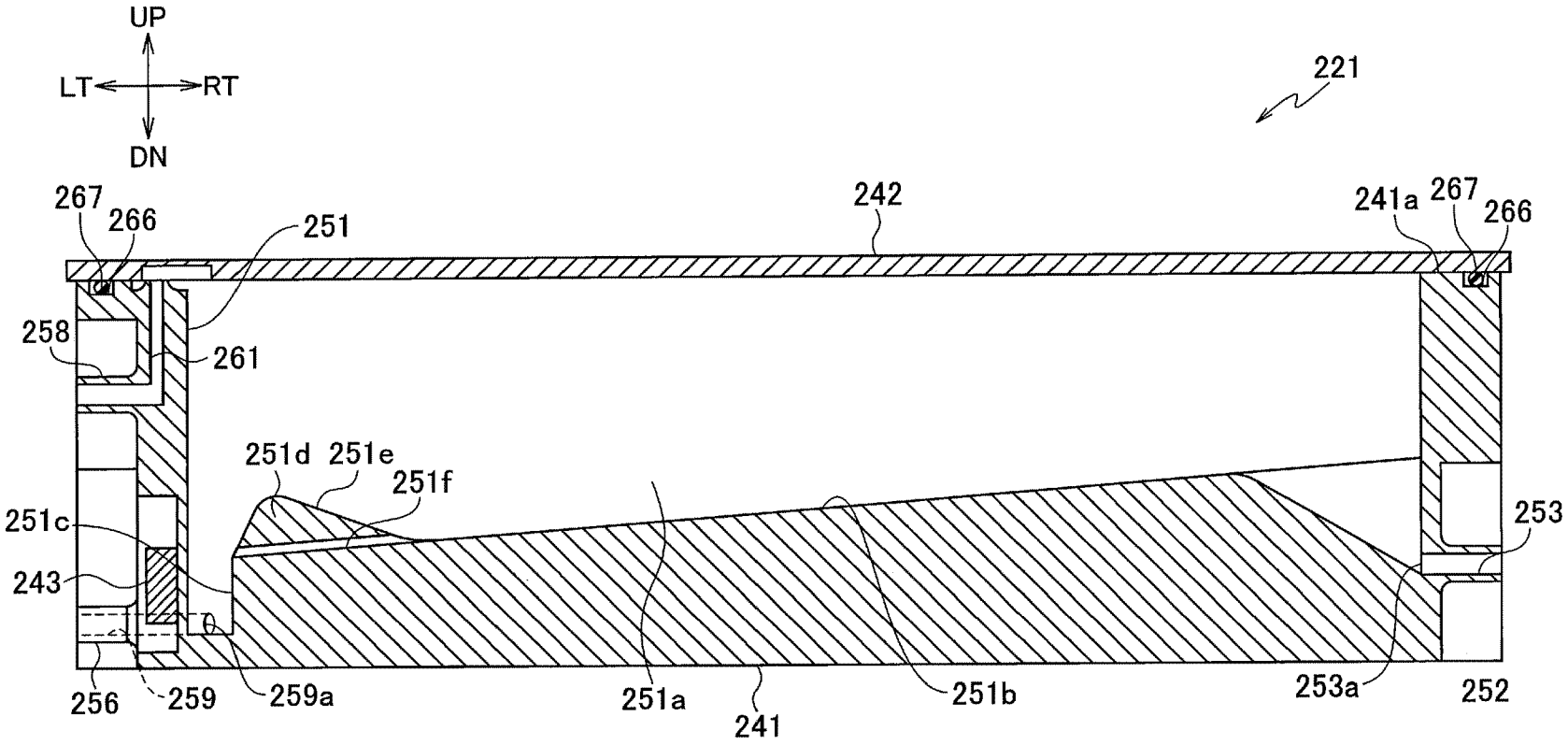
FIG. 25 is a cross-sectional view along line XXIII-XXIII in FIG. 23.
Figure 26:
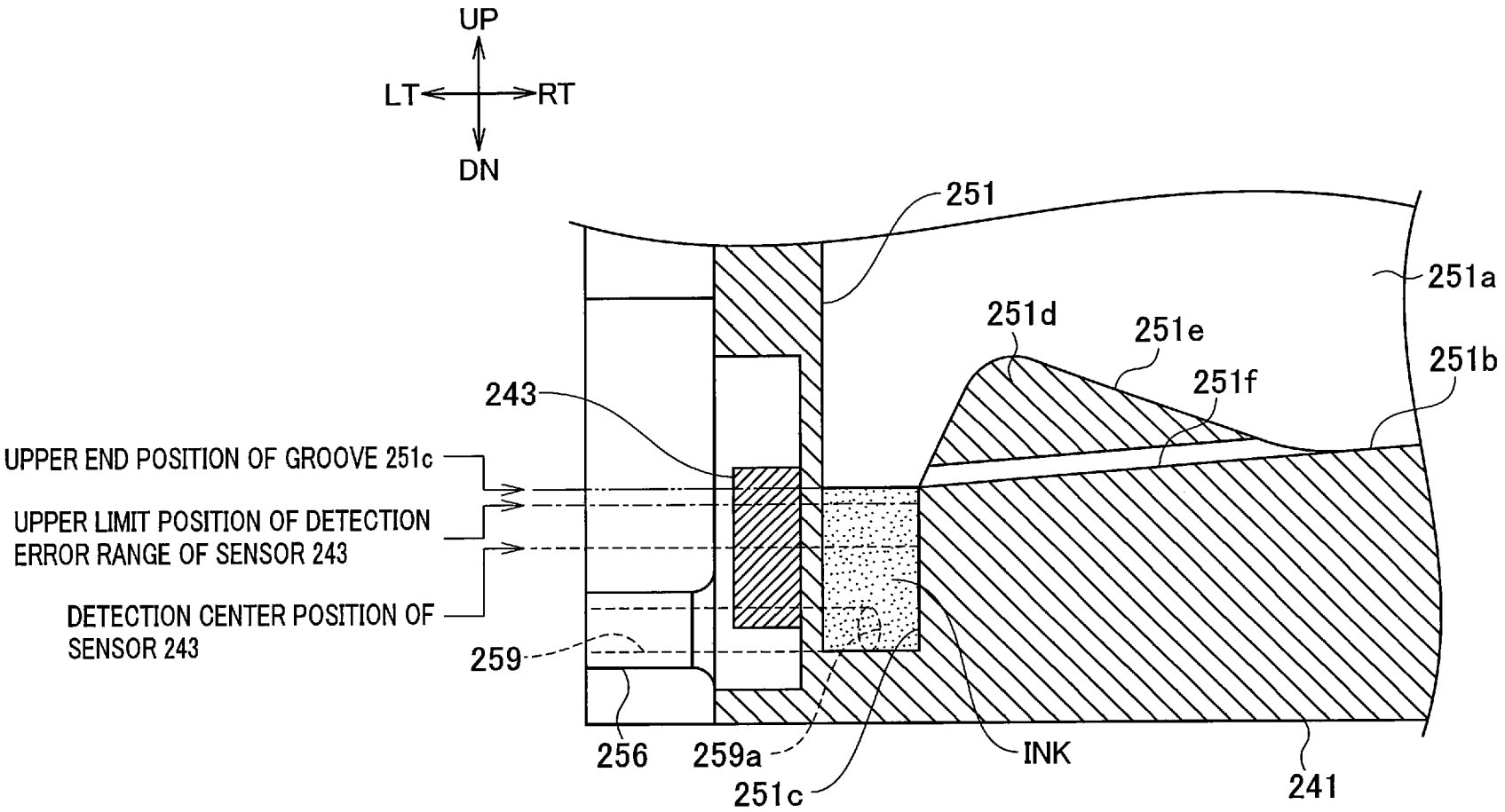
FIG. 26 is a partially enlarged cross-sectional view along line XXIII-XXIII in FIG. 23.
Figure 27:
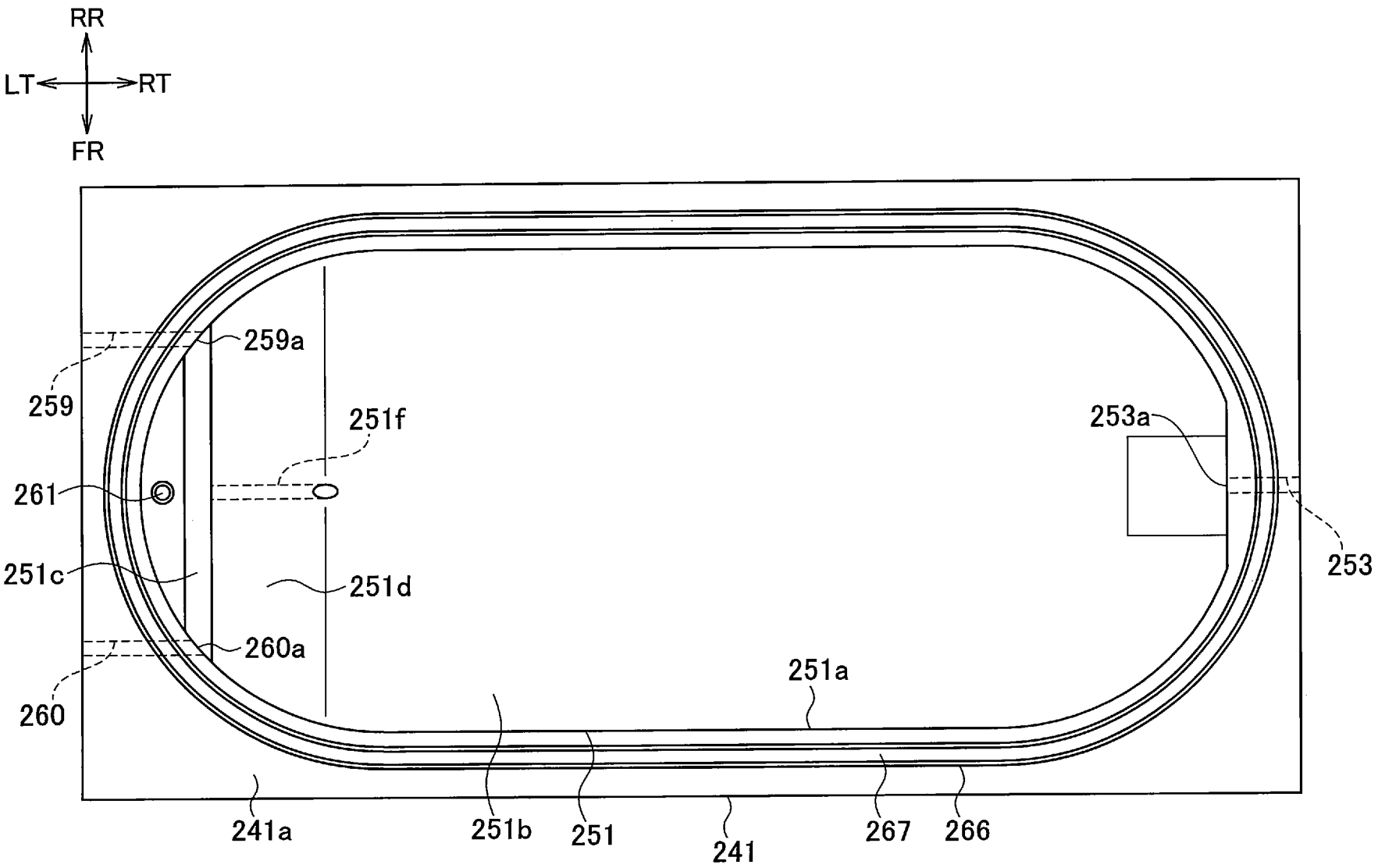
FIG. 27 is a plan view of a tank body according to the fourth embodiment.

FIG. 22 is a schematic configuration diagram of a printing apparatus 201 provided with a tank 221 according to a fourth embodiment of the disclosure. FIG. 23 is a perspective view of the tank 221. FIG. 24 is an exploded perspective view of the tank 221. FIG. 25 is a cross-sectional view along line XXIII-XXIII in FIG. 23. FIG. 26 is a partially enlarged cross-sectional view along line XXIII-XXIII in FIG. 23. FIG. 27 is a plan view of a tank body 241. Note that in the following description, the direction perpendicular to the sheet surface of FIG. 22 is defined as a front-rear direction, and the front side of the sheet surface is defined as the front side. Also, the up-down and left-right directions of the sheet surface of FIG. 22 are defined as up-down and left-right directions, respectively. Here, the up-down direction illustrated in FIG. 22 is the vertical direction. In FIGS. 22 to 30, the rightward direction, leftward direction, upward direction, downward direction, frontward direction, and rearward direction are denoted as RT, LT, UP, DN, FR, and RR, respectively.

As illustrated in FIG. 22, the printing apparatus 201 according to the fourth embodiment includes a printer 202, an ink supply unit 203, and a controller 204.

The printer 202 has an inkjet head (not illustrated) and is configured to print an image on a sheet by ejecting ink onto the sheet from the inkjet head.

The ink supply unit 203 is configured to agitate ink and supply the ink to the printer 202. The ink supply unit 203 includes an ink cartridge 211 and an agitator 212.

Here, the ink used for printing in the printing apparatus 201 is a pigment ink, and its pigment particles may sediment if the ink is left unused. For example, the ink used for printing in the printing apparatus 201 is a magnetic ink character reader (MICR) ink containing metallic particles being magnetic bodies. The sedimentation of the pigment particles in the ink causes troubles such as ejection failure at the inkjet head and variation in the concentration of the ejected ink. Since the pigment particles in the ink may have sedimented inside the ink cartridge 211, the printing apparatus 201 agitates the ink in the agitator 212. In this way, if the pigment particles have sedimented, the sedimentation is solved.

The agitator 212 is configured to obtain ink from the ink cartridge 211 and agitate the obtained ink. The agitator 212 is configured to supply the agitated ink to the printer 202. The agitator 212 includes the tank 221, an atmosphere opening pipe 222, an air filter 223, an ink transfer pipe 224, an ink outlet pipe 225, an ink transfer valve 226, an agitation valve 227, a pump 228, an ink supply pipe 229, and an ink supply valve 230.

The tank 221 is configured to store the ink obtained from the ink cartridge 211 to agitate it. Details of the tank 221 will be described later.

The atmosphere opening pipe 222 forms an air channel for opening the tank 221 to the atmosphere. The atmosphere opening pipe 222 is connected at one end to the tank 221 and communicates at the other end with the atmosphere through the air filter 223. The air filter 223 is configured to prevent dust and the like in the air from entering the atmosphere opening pipe 222.

The ink transfer pipe 224 is configured to connect the ink cartridge 211 and the tank 221. The ink transfer pipe 224 forms a transfer route 200Rt being a route through which to transfer ink from the ink cartridge 211 to the tank 221.

The ink outlet pipe 225 is configured to connect the tank 221 and the ink transfer pipe 224.

The ink outlet pipe 225 and the portion of the ink transfer pipe 224 on the tank 221 side from the point to which the ink outlet pipe 225 is connected form an agitation route 200Rs. The agitation route 200Rs is a route outside the tank 221 through which to circulate the ink in the tank 221 to agitate it.

The ink transfer valve 226 is configured to open and close the ink channel in the ink transfer pipe 224. The ink transfer valve 226 is arranged at the portion of the ink transfer pipe 224 on the ink cartridge 211 side from the point to which the ink outlet pipe 225 is connected.

The agitation valve 227 is configured to open and close the ink channel in the ink outlet pipe 225.

The ink transfer valve 226 and the agitation valve 227 switch the route to be opened between the transfer route 200Rt and the agitation route 200Rs. Specifically, by opening the ink transfer valve 226 and closing the agitation valve 227, the printing apparatus 201 is brought into a state where the transfer route 200Rt is opened and the agitation route 200Rs is closed. By closing the ink transfer valve 226 and opening the agitation valve 227, the printing apparatus 201 is brought into a state where the agitation route 200Rs is opened and the transfer route 200Rt is closed.

The pump 228 is configured to move ink such that ink flows out from the tank 221 and flows back into the tank 221 through the agitation route 200Rs to thereby agitate the ink in the tank 221. The pump 228 is also used to transfer ink from the ink cartridge 211 to the tank 221. The pump 228 is arranged at the overlapping portion of the transfer route 200Rt and the agitation route 200Rs. Specifically, the pump 228 is arranged at the portion of the ink transfer pipe 224 on the tank 221 side from the point to which the ink outlet pipe 225 is connected.

The ink supply pipe 229 is configured to connect the tank 221 and the printer 202.

The ink supply valve 230 is configured to open and close the ink channel in the ink supply pipe 229. By opening the ink supply valve 230, ink is supplied from the tank 221 to the printer 202.

The controller 204 is configured to control the operations of components in the printing apparatus 201. The controller 204 includes a CPU, an RAM, an ROM, a hard disk drive, and so on.

Next, details of the tank 221 will be described.

The tank 221 includes the tank body 241, a lid 242, and a sensor 243.

The tank body 241 is configured to store ink transferred from the ink cartridge 211. The tank body 241 is formed in a substantially cuboidal shape.

The tank body 241 has an ink container 251 (liquid container). The ink container 251 is a portion configured to store ink (liquid). The ink container 251 is formed by recessing an upper surface 241*a* of the tank body 241, and has a peripheral wall 251*a* and a bottom surface 251*b*.

A peripheral wall 251*a* of the ink container 251 is formed in a substantially oval shape elongated in the left-right direction in a plan view. Specifically, the peripheral wall 251*a* has curved portions at a left end portion and a right end portion of the ink container 251. This makes it easier for ink to flow from a later-described inlet opening 253*a* side (right side) to a later-described outlet opening 259*a* side (left side) and thus improves the ink agitation efficiency.

The bottom surface 251*b* of the ink container 251 is inclined downward toward the left side. Specifically, the bottom surface 251*b* is inclined to be lower from the inlet opening 253*a* side (right side) to the outlet opening 259*a* side (left side). This makes it easier for ink to flow from the inlet opening 253*a* side to the outlet opening 259*a* side and thus improves the ink agitation efficiency.

A groove 251*c* elongated in the front-rear direction is formed in a left end portion of the bottom surface 251*b*. The groove 251*c* is a portion in which ink remains to the last in a situation where the remaining volume of ink in the ink container 251 has decreased to a small volume. The recess 251*c* is formed by recessing the bottom surface 251*b*. The outlet opening 259*a* and a later-described supply opening 260*a* are open at the groove 251*c*.

On the bottom surface 251*b*, a protrusion 251*d* protruding upward is formed adjacent to the upstream side (right side) of the groove 251*c* in the direction of ink flow from the inlet opening 253*a* to the outlet opening 259*a*. The protrusion 251*d* has an inclined surface 251*e* that becomes higher toward the left side. The protrusion 251*d* is configured to guide the ink flow obliquely upward toward the left side with the inclined surface 251*e*.

In the bottom surface 251*b*, a through-hole 251*f* is formed which penetrates through the protrusion 251*d* in the left-right direction. The through-hole 25 if forms a channel through which ink is caused to flow from the right side of the protrusion 251*d* into the groove 251*c*. The through-hole 251*f* prevents ink from accumulating in the recess at the boundary between the protrusion 251*d* and the portion on the right side of the protrusion 251*d*.

An ink inlet port 252 is provided on a right side portion of the tank body 241. The ink inlet port 252 is configured to connect the ink transfer pipe 224 to the tank body 241. An ink inlet hole 253 is formed in the ink inlet port 252.

The ink inlet hole 253 is open at one end in the ink inlet port 252 and is open at the other end to the bottom surface 251*b* of the ink container 251. Thus, the ink inlet hole 253 communicates with the ink container 251, so that ink flows in from the ink transfer pipe 224 to the ink container 251 through the ink inlet hole 253. The opening of the ink inlet hole 253 at the ink container 251 is the inlet opening 253*a*, through which ink is caused to flow into the ink container 251. The inlet opening 253*a* is open at a recess formed in the right end portion of the ink container 251 by recessing the bottom surface 251*b*.

An ink outlet port 256, an ink supply port 257, and an atmosphere opening port 258 are provided on a left side portion of the tank body 241.

The ink outlet port 256 is configured to connect the ink outlet pipe 225 to the tank body 241. An ink outlet hole 259 is formed in the ink outlet port 256.

The ink outlet hole 259 is open at one end in the ink outlet port 256 and is open at the other end to the ink container 251. Thus, the ink outlet hole 259 communicates with the ink container 251, so that ink flows out from the ink container 251 to the ink outlet pipe 225 through the ink outlet hole 259. The opening of the ink outlet hole 259 at the ink container 251 is the outlet opening 259*a*, through which ink is caused to flow out from the ink container 251 to the ink outlet pipe 225. The outlet opening 259*a* is open at the groove 251*c* at a position on the rear side relative to the center of the ink container 251 in the front-rear direction.

The ink supply port 257 is configured to connect the ink supply pipe 229 to the tank body 241. An ink supply hole 260 is formed in the ink supply port 257.

The ink supply hole 260 is open at one end in the ink supply port 257 and is open at the other end to the ink container 251. Thus, the ink supply hole 260 communicates with the ink container 251, so that ink flows out from the ink container 251 to the ink supply pipe 229 through the ink supply hole 260. The opening of the ink supply hole 260 at the ink container 251 is a supply opening (discharge opening) 260*a* through which ink is discharged from the ink container 251 to supply the ink to the printer 202 through the ink supply pipe 229. The supply opening 260*a* is open at the groove 251*c* at a position on the front side relative to the center of the ink container 251 in the front-rear direction.

The atmosphere opening port 258 is configured to connect the atmosphere opening pipe 222 to the tank body 241. An atmosphere communication hole 261 is formed in the atmosphere opening port 258. The atmosphere communication hole 261 allows the internal space of the tank body 241 covered by the lid 242 (ink container 251) to communicate with the atmosphere to thereby open the tank 221 to the atmosphere. The atmosphere communication hole 261 is open at one end in the atmosphere opening port 258 and is open at the other end to an upper surface 241*a* of the tank body 241.

A seal groove 266 is formed in the tank body 241. The seal groove 266 is formed to surround the ink container 251. The seal groove 266 is a groove in which to install a seal member 267. The seal member 267 is a member configured to prevent leakage of the ink in the ink container 251 from the tank 221.

The lid 242 is configured to cover the top of the tank body 241. The lid 242 is placed on the upper surface 241*a* of the tank body 241.

The sensor 243 is configured to detect whether the ink level in the groove 251*c* is lower than a predetermined lower limit level. The sensor 243 is used to determine whether the ink in the ink container 251 has run out. The sensor 243 is configured to output a signal indicating "ON" when the ink level in the groove 251*c* is higher than or equal to the lower limit level, and output a signal indicating "OFF" when the ink level in the groove 251*c* is lower than the lower limit level.

Here, the sensor 243 has an error in the ink level detection. As illustrated in FIG. 26, the sensor 243 is installed such that the upper limit position of its detection error range centered at a detection center position is set at a position lower than the upper end position of the groove 251*c*. Specifically, the upper limit position of a detection range being a range from the lower limit position to the upper limit position of the detection error range of the sensor 243 is set at a position lower than the upper end position of the groove 251*c*. Here, the upper end position of the groove 251*c* is the lower end position of the left opening of the through-hole 25 if.

Next, the operation of the printing apparatus 201 will be described.

When performing printing, the controller 204 causes the printer 202 to eject ink from its inkjet head onto a sheet. As a result, ink is consumed, and if ink needs to be supplied to the printer 202, the controller 204 opens the ink supply valve 230. With the ink supply valve 230 opened, ink in the ink container 251 is discharged from the supply opening 260*a* and supplied to the printer 202 through the ink supply pipe 229. After a necessary volume of ink is supplied, the controller 204 closes the ink supply valve 230.

As ink is supplied to the printer 202, the volume of ink in the ink container 251 decreases, so that the surface of the ink lowers. If the sensor 243 then shifts to the off state, the controller 204 determines that the ink in the ink container 251 has run out, and closes the ink supply valve 230. Here, as mentioned above, the sensor 243 is arranged such that the upper limit position of its detection error range is a position lower than the upper end position of the groove 251*c*. Thus, although the sensor 243 has its detection error, the sensor 243 shifts to the off state after the ink level lowers to a position lower than the upper end position of the groove 251*c*.

If determining that the ink has run out with the sensor 243 shifting to the off state, the controller 204 executes transfer of ink from the ink cartridge 211 to the tank 221.

Specifically, the controller 204 opens the ink transfer valve 226 and closes the agitation valve 227. As a result, the printing apparatus 201 is brought into the state where the transfer route 200Rt is opened and the agitation route 200Rs is closed. Meanwhile, the printing apparatus 201 is equipped with a new ink cartridge 211.

Then, the controller 204 starts driving the pump 228. As a result, ink is transferred from the ink cartridge 211 to the tank 221 through the transfer route 200Rt.

After the ink in the ink cartridge 211 is all transferred to the tank 221, the controller 204 closes the ink transfer valve 226 and opens the agitation valve 227. As a result, the printing apparatus 201 is switched to the state where the agitation route 200Rs is opened and the transfer route 200Rt is closed. Ink is then circulated along the agitation route 200Rs, so that the ink in the tank 221 is agitated.

After the elapse of a prescribed time since the start of the agitation of the ink in the tank 221, the controller 204 stops the pump 228 and closes the agitation valve 227. As a result, the ink agitation operation by the agitator 212 is finished. Note that printing can be continued using the ink stored in the printer 202 during the ink transfer from the ink cartridge 211 to the tank 221 and the agitation operation.

The agitation operation in the agitator 212 is performed not only immediately after the above-described ink transfer from the ink cartridge 211 to the tank 221 but also at regular intervals of a predetermined time, for example, in order to prevent sedimentation of the pigment particles in the ink in the tank 221.

Figure 28:
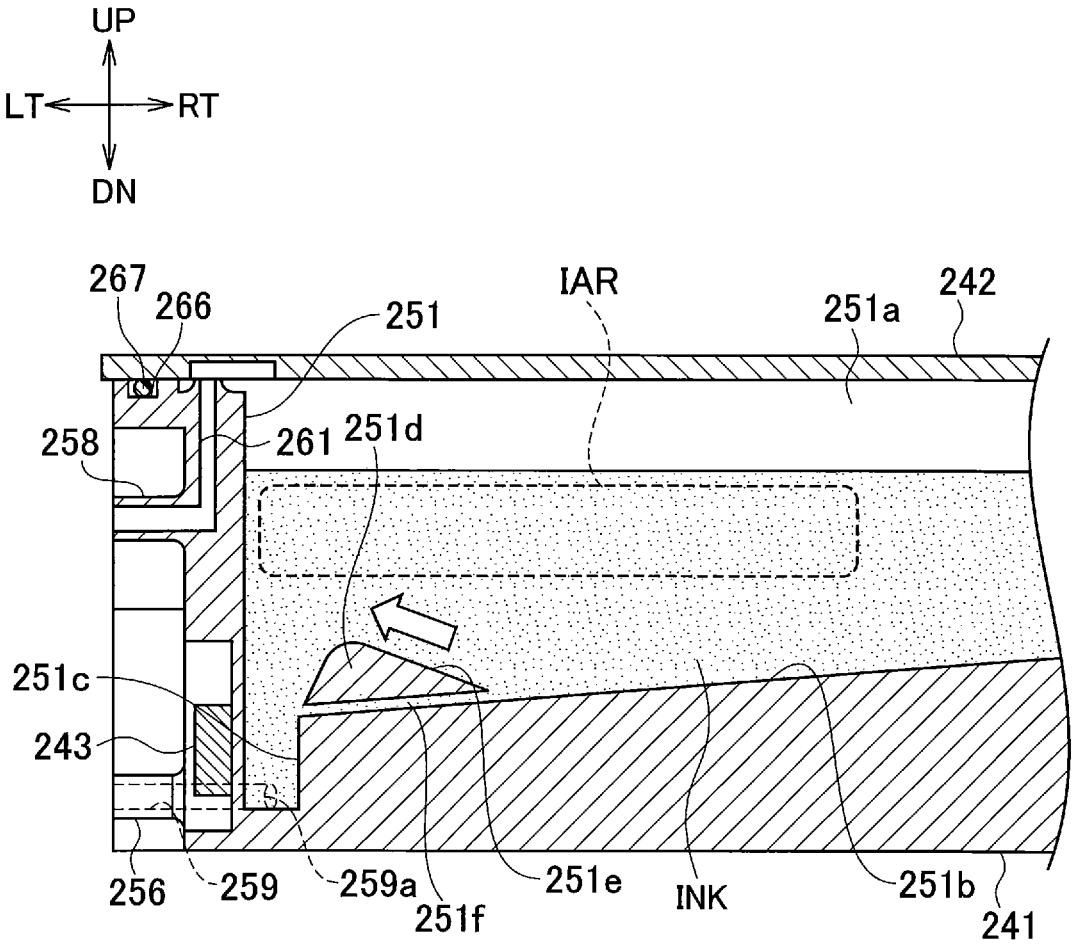
FIG. 28 is an explanatory diagram of the flow of ink in the tank during an agitation operation according to the fourth embodiment.

During the above-described agitation operation, ink having flowed into the ink container 251 from the inlet opening 253*a* flows through the ink container 251 toward the left side and then flows out from the outlet opening 259*a*. In doing so, as illustrated in FIG. 28, the ink having reached the protrusion 251*d* is guided by the inclined surface 251*e* to flow obliquely upward to the left side. As a result, the ink flows into a region IAR, or an upper region of the left side (outlet opening 259*a* side) of the ink container 251, in which ink stagnation is likely to occur, thereby reducing the stagnation.

Here, the ink flow in the left side of the ink container 251 generated by suction of ink from the outlet opening 259*a* is strong in a lower portion of the ink container 251 but weak in an upper portion. For this reason, ink stagnation is likely to occur in the upper region of the left side of the ink container 251.

As described above, in the printing apparatus 201, the sensor 243 is installed such that the upper limit position of its detection range is set at a position lower than the upper end position of the groove 251*c*. Thus, although the sensor 243 has its detection error, the sensor 243 is prevented from shifting to the off state when the ink surface is at a position higher than the upper end position of the groove 251*c*.

Here, consider a case where, unlike the fourth embodiment, the upper limit position of the detection range of the sensor 243 is at a position higher than the upper end position of the groove 251*c*. In this case, the sensor 243 may shift to the off state when the ink surface is at a position higher than the upper end position of the groove 251*c*. If this occurs, the controller 204 determines that the ink has run out when ink is still remaining up to the outside of the groove 251*c*.

If the controller 204 determines that the ink in the ink container 251 has run out, the tank 221 will be replenished with ink from a new ink cartridge 211, as mentioned above. However, the tank 221 will not be replenished with ink from the ink cartridge 211 in the case where the printing apparatus 201 finishes being used in the above state. In this case, the ink remaining in the tank 221 will not be used and is therefore wasted. For this reason, the smaller the volume of ink remaining when the controller 204 determines that the ink has run out, the better.

On the other hand, in the fourth embodiment, although the sensor 243 has its detection error, the sensor 243 shifts to the off state after the ink level lowers to a position lower than the upper end position of the groove 251*c*. Thus, the controller 204 is prevented from determining that the ink has run out when ink is still remaining up to the outside of the groove 251*c*. This reduces the remaining volume of ink and therefore reduces the ink to be wasted.

In the tank 221, the upwardly protruding protrusion 251*d* is formed on the bottom surface 251*b* at a position adjacent to the upstream side of the groove 251*c*. Thus, during the agitation operation, ink flowing from the inlet opening 253*a* to the outlet opening 259*a* is guided by the protrusion 251*d* to flow obliquely upward toward the left side. This reduces ink stagnation and therefore improves the agitation efficiency.

In the fourth embodiment, the supply opening 260*a*, through which ink is discharged from the ink container 251, and the outlet opening 259*a*, through which ink is caused to flow out from the ink container 251 during the agitation operation, are provided separately. Alternatively, a configuration in which a single opening serves as both of them may be employed.

The sensor 243 may be provided with a member configured to communicate a signal for detecting the ink surface, and the upper end position of this member may be set lower than the upper end position of the groove 251*c*.

The protrusion 251*d* may be omitted. The through-hole 251*f* may be omitted.

In the fourth embodiment, a tank for agitating ink has been described. The tank includes other containers such as an ink cartridge.

In the fourth embodiment, a case of agitating an ink whose pigment particles sediment has been described. However, the ink to be agitated is not limited to an ink whose component sediments but may be an ink whose components become separated, for example.

In the fourth embodiment, the tanks 221 configured to store ink have been described. However, the disclosure is applicable also to tanks configured to store liquids other than ink.

Figure 29:
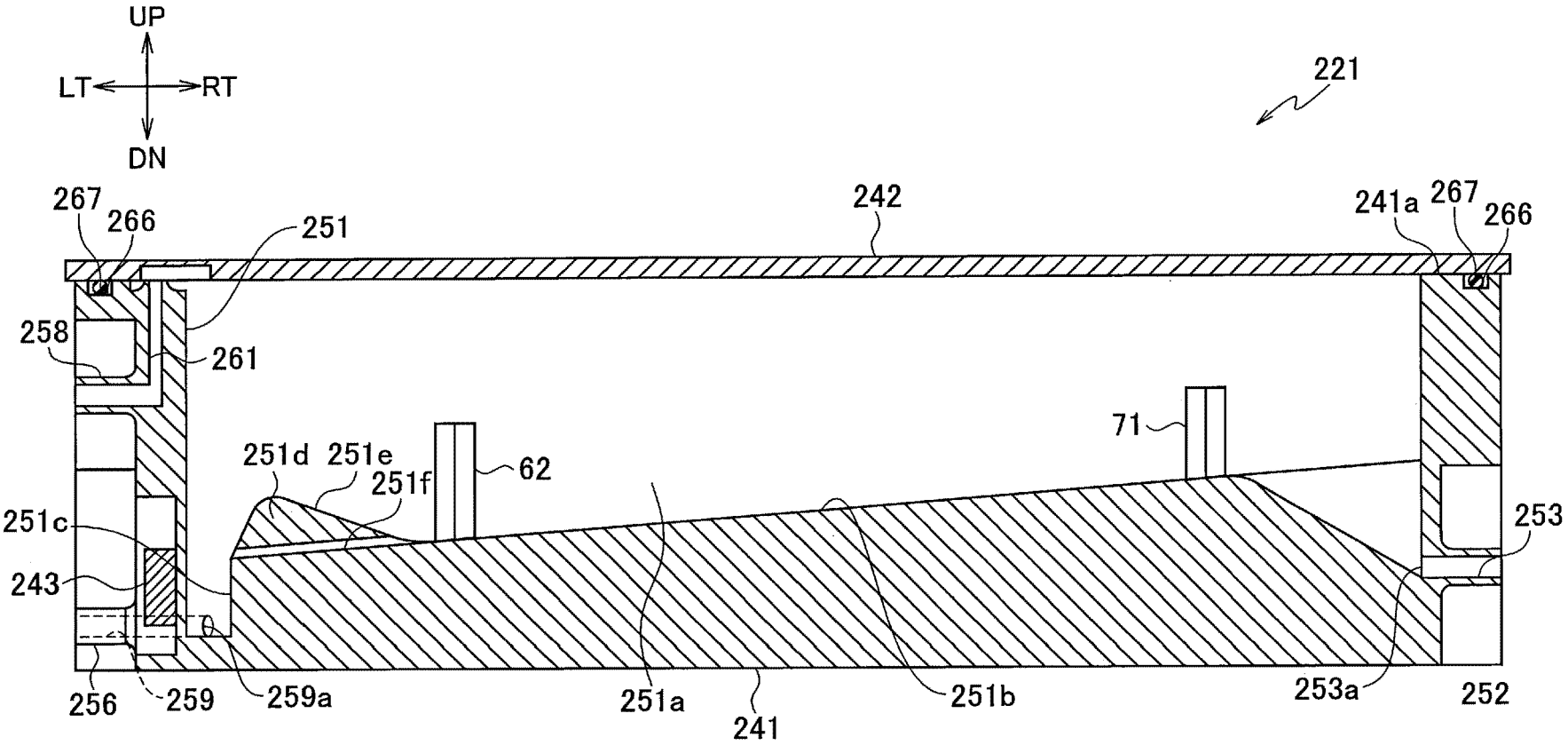
FIG. 29 is a cross-sectional view of a tank according to a modification of the fourth embodiment along line XXIII-XXIII in FIG. 23.
Figure 30:
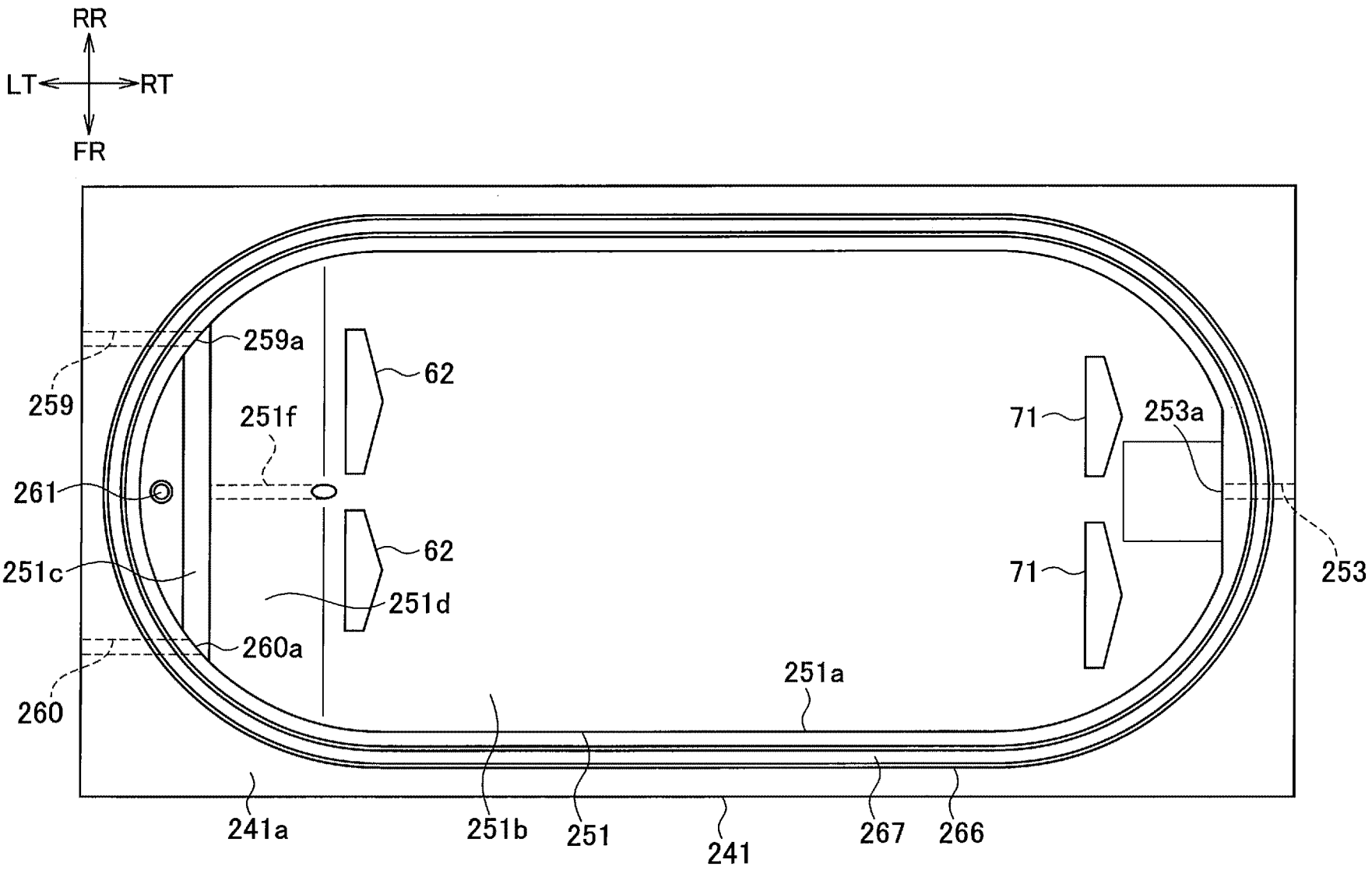
FIG. 30 is a plan view of a tank body according to the modification of the fourth embodiment.

The first embodiment or the second embodiment (including the modifications) may be applied to the tank 221 in the fourth embodiment. The tanks 21 in the first embodiment and the second embodiment (including the modifications) may employ the sensor 243, the groove 251*c*, the protrusion 251*d*, the through-hole 251*f*, and so on in the fourth embodiment. For example, the flow regulation walls 62 and/or the flow regulation walls 71 may be further provided in the tank 221 in the fourth embodiment to form a plurality of channels. In one example, as illustrated in FIGS. 29 and 30, the flow regulation walls 62 may be provided on a portion of the bottom surface 151*b* on the right side of the protrusion 251*d*, and the flow regulation walls 71 may be provided on a portion of the bottom surface 151*b* on the left side of the recess provided on the left side of the inlet opening 253*a*. Also, in the case where the protrusion 251*d* is not provided, the flow regulation walls 62 may be provided on a portion of the bottom surface 151*b* on the right side of the groove 251*c*, as in FIG. 5. The combination of the tank 221 in the fourth embodiment and the first embodiment or the second embodiment (including the modifications) is not limited to the above manner. Any combination is possible as long as the advantageous effects of the embodiments can be achieved.

The embodiment has the following configurations, for example.

A tank in accordance with some embodiments includes: a liquid container configured to store a liquid; a groove formed in a bottom surface of the liquid container; a discharge opening which is open at the groove and through which the liquid is discharged from the liquid container; and a detector configured to detect whether a level of the liquid in the groove is lower than a lower limit level. The detector is installed such that an upper limit position of a detection range of the detector for the level of the liquid is set at a position lower than an upper end position of the groove.

The tank may further include: an outlet opening which is open at the groove and through which the liquid in the liquid container flows out from the liquid container to an outside route to circulate the liquid through the route; and an inlet opening through which the liquid flows into the liquid container from the route. The bottom surface of the liquid container may have a protrusion formed adjacent to an upstream side of the groove in a direction of flow of the liquid from the inlet opening to the outlet opening.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A tank comprising:

a liquid container configured to store a liquid;

an inlet opening through which the liquid flows into the liquid container;

an outlet opening through which the liquid flows out from the liquid container; and a channel formation member arranged between the inlet opening and the outlet opening and configured to form channels, wherein the channels are non-overlapping in a fluid flow direction, and wherein the channels comprise inlet channels different distances from the inlet opening or outlet channels different distances from the outlet opening, and as the distance from the inlet channels to the inlet opening increases, the widths of the inlet channels increases, or as the distance from the outlet channels to the outlet opening increases, the widths of the outlet channels increases.

2. The tank according to claim 1, wherein the channel formation member comprises a first channel formation member arranged at a side of the outlet opening and configured to form the outlet channels.

3. The tank according to claim 1, wherein the channel formation member comprises a second channel formation member arranged at a side of the inlet opening and configured to form the inlet channels, and each of the inlet channels has a width corresponding to a direction and intensity of a flow of the liquid flowing into the liquid container from the inlet opening and a distance from the inlet opening to the inlet channel.

4. The tank according to claim 2, wherein the channel formation member comprises a second channel formation member arranged at a side of the inlet opening and configured to form inlet channels, and each of the inlet channels has a width corresponding to a direction and intensity of a flow of the liquid flowing into the liquid container from the inlet opening and a distance from the inlet opening to the inlet channel.

5. The tank according to claim 3, wherein the channel formation member comprises a first channel formation member arranged at a side of the outlet opening and configured to form the outlet channels.

6. The tank according to claim 1, wherein a height of an upper end of the channel formation member is equal to or more than a prescribed height depending on a maximum depth of the liquid at a position where the channel formation member is installed, and less than the maximum depth of the liquid at the position where the channel formation member is installed.

7. The tank according to claim 2, wherein a height of an upper end of the first channel formation member is equal to or more than a prescribed height depending on a maximum depth of the liquid at a position where the first channel formation member is installed, and less than the maximum depth of the liquid at the position where the first channel formation member is installed.

8. The tank according to claim 3, wherein a height of an upper end of the second channel formation member is equal to or more than a prescribed height depending on a maximum depth of the liquid at a position where the second channel formation member is installed, and less than the maximum depth of the liquid at the position where the second channel formation member is installed.

9. The tank according to claim 4, wherein a height of an upper end of the first channel formation member is equal to or more than a prescribed height depending on a maximum depth of the liquid at a position where the first channel formation member is installed, and less than the maximum depth of the liquid at the position where the first channel formation member is installed, and a height of an upper end of the second channel formation member is equal to or more than a prescribed height depending on a maximum depth of the liquid at a position where the second channel formation member is installed, and less than the maximum depth of the liquid at the position where the second channel formation member is installed.

10. The tank according to claim 1, wherein the liquid container comprises a recess which is formed in a bottom surface of the liquid container and at which the inlet opening is open.

11. The tank according to claim 10, wherein the recess comprises an inclined portion having a height increasing from the inlet opening toward the outlet opening.

12. The tank according to claim 10, wherein the inlet opening is arranged at a lower end portion of the recess.

13. The tank according to claim 11, wherein the inlet opening is arranged at a lower end portion of the recess.

14. The tank according to claim 1, further comprising:

a groove formed in a bottom surface of the liquid container;

a discharge opening which is open at the groove and through which the liquid is discharged from the liquid container; and a detector configured to detect whether a level of the liquid in the groove is lower than a lower limit level, wherein the detector is installed with an upper limit position of a detection range of the detector for the level of the liquid being at a position lower than an upper end position of the groove.

15. The tank according to claim 14, wherein the outlet opening is open at the groove and allows the liquid in the liquid container to flow out from the liquid container to a route outside the liquid container to circulate the liquid through the route, the inlet opening allows the liquid to flow into the liquid container from the route, and the bottom surface of the liquid container comprises a protrusion formed adjacent to an upstream side of the groove in a direction of flow of the liquid from the inlet opening to the outlet opening.

16. A tank comprising:

a liquid container configured to store a liquid;

an inlet opening through which the liquid flows into the liquid container;

an outlet opening through which the liquid flows out from the liquid container;

a channel formation member arranged between the inlet opening and the outlet opening and configured to form channels;

a groove formed in a bottom surface of the liquid container;

a discharge opening which is open at the groove and through which the liquid is discharged from the liquid container; and a detector configured to detect whether a level of the liquid in the groove is lower than a lower limit level, wherein the channels comprise inlet channels different distances from the inlet opening or outlet channels different distances from the outlet opening, and as the distance from the inlet channels to the inlet opening increases, the widths of the inlet channels increases, or as the distance from the outlet channels to the outlet opening increases, the widths of the outlet channels increases, wherein the detector is installed with an upper limit position of a detection range of the detector for the level of the liquid being at a position lower than an upper end position of the groove, wherein the outlet opening is open at the groove and allows the liquid in the liquid container to flow out from the liquid container to a route outside the liquid container to circulate the liquid through the route, wherein the inlet opening allows the liquid to flow into the liquid container from the route, and wherein the bottom surface of the liquid container comprises a protrusion formed adjacent to an upstream side of the groove in a direction of flow of the liquid from the inlet opening to the outlet opening.

* * * * *